US007309219B2

(12) United States Patent
Komai et al.

(10) Patent No.: US 7,309,219 B2
(45) Date of Patent: Dec. 18, 2007

(54) SCROLL TYPE FLUID MACHINERY

(75) Inventors: Yuji Komai, Tokyo (JP); Hideaki Ikeda, Kanagawa-ken (JP); Kazutaka Suefuji, Kanagawa-ken (JP); Koji Fukui, Tokyo (JP); Susumu Sakamoto, Kanagawa-ken (JP); Masanori Sugimoto, Kanagawa-ken (JP)

(73) Assignee: HItachi, Ltd., Tokyo (JP)

( * ) Notice: Subject to any disclaimer, the term of this patent is extended or adjusted under 35 U.S.C. 154(b) by 69 days.

(21) Appl. No.: 11/014,999

(22) Filed: Dec. 20, 2004

(65) Prior Publication Data

US 2005/0169788 A1 Aug. 4, 2005

(30) Foreign Application Priority Data

Dec. 26, 2003 (JP) ..... 2003-434485

(51) Int. Cl.
*F01C 1/02* (2006.01)

(52) U.S. Cl. ..... 418/55.1; 418/101

(58) Field of Classification Search ..... 418/55, 418/55.2, 55.3, 55.4, 55.5, 83, 101, 55.1
See application file for complete search history.

(56) References Cited

U.S. PATENT DOCUMENTS 4,082,484 A * 4/1978 McCullough ..... 418/55.2
5,417,554 A * 5/1995 Kietzman et al. ..... 418/55.2
6,109,897 A * 8/2000 Haga ..... 418/55.1
6,190,145 B1 * 2/2001 Fujioka et al. ..... 418/55.1

FOREIGN PATENT DOCUMENTS

JP 2002-13492 1/2002

* cited by examiner

*Primary Examiner*—Hoang Nguyen
(74) *Attorney, Agent, or Firm*—Wenderoth, Lind & Ponack, L.L.P.

(57) ABSTRACT

The present invention provides a scroll type fluid machine which enables both of a fixed scroll and an orbiting scroll to be cooled by means of a cooling fan, and which enables an overall size of the machine to be compact. Cooling fans 38A and 38B are connected to a rotary shaft 18 between an electric motor 15 and orbiting scrolls 26A and 26B. Outer cases 3A and 3B are provided with flow inlet openings 42A and 42B, flow outlet openings 43A and 43B, scroll ducts 44A and 44B and cooling device ducts 46A and 46B. Compression portions 6A and 6B are operated by rotatably driving the rotary shaft 18 using the electric motor 15. In this instance, the cooling fans 38A and 38B are rotated with the rotary shaft. Therefore, with a simple structure having no electric fans, the fixed scrolls 7A and 7B, the orbiting scrolls 26A and 26B and the cooling device 47 can be efficiently cooled, and a compressor having a compact size and a high cooling performance can be formed.

8 Claims, 11 Drawing Sheets

SCROLL TYPE FLUID MACHINERY

BACKGROUND OF THE INVENTION

The present invention relates to scroll type fluid machinery which can be suitably used, for example, for compressors for air or refrigerant, vacuum pumps, and the like.

Generally, as an example of scroll type fluid machinery, there is known a scroll type air compressor in which orbiting scrolls are respectively provided on axially opposite sides of a rotary shaft. By driving the rotary shaft, compression of air or the like is conducted at axially opposite sides of the shaft (see, for example, Japanese Patent Application Public Disclosure No. 2002-13492).

In a conventional air compressor of this type, first and second fixed scrolls are provided on axially opposite sides of a cylindrical casing. These fixed scrolls each comprise an end plate and a spiral wrap portion extending from a front surface of the end plate.

In the casing, there are provided a rotary shaft comprising a cylindrical rod and an electric motor for rotatably driving the rotary shaft. A connecting shaft is rotatably provided on an inner circumferential surface of the rotary shaft and extends through the rotary shaft. The center axis of the connecting shaft is radially offset from the center axis of the rotary shaft by a predetermined amount, and opposite ends of the connecting shaft project from axially opposite ends of the rotary shaft, to thereby form crank portions which are eccentric with respect to the rotary shaft.

These crank portions are connected to first and second orbiting scrolls, respectively. The orbiting scrolls each comprise an end plate and a spiral wrap portion extending from a front surface of the end plate. The wrap portion of each orbiting scroll overlaps the wrap portion of the first or second fixed scroll, to thereby define a plurality of compression chambers.

The end plate of each orbiting scroll is a plate-like member comprising two layers, with cooling fins and cooling air passages being formed therein. A metal plate or the like for connection with the connecting shaft is provided on a reverse side of the end plate.

To operate the air compressor, the rotary shaft is rotatably driven by means of the electric motor, and the first and second orbiting scrolls connected to opposite ends of the rotary shaft each perform an orbiting motion with respect to the fixed scrolls, to thereby compress air between the first fixed scroll and the first orbiting scroll, and between the second fixed scroll and the second orbiting scroll.

In this case, the respective end plates of the fixed scrolls and the orbiting scrolls are subject to high temperatures due to compression heat generated during a compression operation. Therefore, in the conventional air compressor, an electric cooling fan comprising an electric motor is provided in the vicinity of an outer periphery of each of the first and second fixed scrolls.

Then, during air compressor operation, the two electric fans are operated by externally supplying power to the motors so that one electric fan cools the reverse sides of the first fixed scroll and the first orbiting scroll, while the other fan cools the reverse sides of the second fixed scroll and the second orbiting scroll.

Thus, in the above-mentioned prior art, an electric fan is provided at an outer periphery of each of the first and second fixed scrolls. In this case, the two electric fans radially project from opposite ends of the air compressor. Therefore, a radial dimension of the compressor is large.

Further, due to attachment of two electric fans, a reduction in cost of the compressor is difficult. Due to operation of the electric fans, the compressor generates pronounced noise and a large amount of heat, and power consumption increases, resulting in poor product quality. In addition, in the compressor casing and the fixed scrolls, portions for attachment of the electric fans must be formed, and wiring for supply of power to the electric fans is required. Therefore, the structures of the casing and the fixed scrolls are complicated.

Further, in the conventional compressor, the end plate of the orbiting scroll is imparted with a two-layer structure so as to increase cooling performance, and an attachment plate to be connected to the connecting shaft is provided on the reverse side of the end plate. This complicates the structure of the orbiting scroll and requires cumbersome operations for machining and assembling the orbiting scroll, thus lowering productivity.

SUMMARY OF THE INVENTION

In view of the above-mentioned problems accompanying the prior art, the present invention has been made. It is an object of the present invention to provide a scroll type fluid machine which comprises a simple cooling structure, to thereby reduce an overall size of the machine while securing high cooling performance to sufficiently cool wide areas on axially opposite sides of the casing, and which is capable of suppressing noise and power consumption.

The present invention provides a scroll type fluid machine comprising:

a fixed-side member including a casing and a fixed scroll provided in the casing, the fixed scroll being formed by an end plate and a spiral wrap portion extending from a front surface of the end plate;

an electric motor provided in the casing;

a rotary shaft supported by the casing and adapted to be rotatably driven by the electric motor; and an orbiting scroll connected to the rotary shaft at a position where the orbiting scroll faces the fixed scroll, the orbiting scroll being formed by an end plate and a wrap portion extending from a front surface of the end plate, the wrap portion of the orbiting scroll overlapping the wrap portion of the fixed scroll, to thereby form a plurality of compression chambers, the rotary shaft being provided with a cooling fan accommodated in the fixed-side member, the cooling fan being adapted to rotate with the rotary shaft at a position where the cooling fan faces the orbiting scroll, the fixed-side member being provided with a flow inlet opening for sucking cooling air along a reverse side of the orbiting scroll end plate during rotation of the cooling fan, a flow outlet opening for allowing the cooling air sucked from the flow inlet opening to be discharged from the fixed-side member by operation of the cooling fan, and a scroll duct for guiding the cooling air discharged from the flow outlet opening towards a reverse side of the fixed scroll end plate.

In the present invention, while an orbiting motion of the orbiting scroll is performed by means of the electric motor, the cooling fan can be rotated with the orbiting scroll. Therefore, the cooling fan is capable of sucking cooling air from the flow inlet opening along the reverse side of the orbiting scroll, thus cooling the end plate of the orbiting scroll efficiently by means of this cooling air. The cooling fan is also capable of discharging the cooling air through the flow outlet opening into the scroll duct, to thereby efficiently cool the end plate of the fixed scroll.

Thus, the cooling fan can be driven by utilizing the electric motor as a power source of the machine. Differing from the prior art, in the present invention it is not necessary to use electric fans. Therefore, a reduction in the number of parts, such as electric fans, can be achieved, thereby reducing costs. Further, generation of pronounced noise and a large amount of heat, and high power consumption due to the use of electric fans is also avoided.

Since the electric motor and the cooling fan can be arranged in an axial direction of the rotary shaft, a radial dimension of the machine can be reduced while ensuring sufficiently high cooling performance. Therefore, the casing, the orbiting scroll and a cooling structure therefor can be simplified, and an operation for assembly can be efficiently conducted.

The present invention also provides a scroll type fluid machine comprising:

a fixed-side member including a casing and a fixed scroll provided in the casing, the fixed scroll being formed by an end plate and a spiral wrap portion extending from a front surface of the end plate;

an electric motor provided in the casing;

a rotary shaft supported by the casing and adapted to be rotatably driven by the electric motor; and an orbiting scroll connected to the rotary shaft at a position where the orbiting scroll faces the fixed scroll, the orbiting scroll being formed by an end plate and a wrap portion extending from a front surface of the end plate, the wrap portion of the orbiting scroll overlapping the wrap portion of the fixed scroll, to thereby form a plurality of compression chambers, the rotary shaft being provided with a cooling fan accommodated in the fixed-side member, the cooling fan being adapted to rotate with the rotary shaft at a position where the cooling fan faces the orbiting scroll, the fixed-side member being provided with a flow inlet opening for sucking cooling air into the casing during rotation of the cooling fan, a flow outlet opening for allowing the cooling air sucked from the flow inlet opening to be discharged from the fixed-side member by operation of the cooling fan, a scroll duct for guiding the cooling air discharged from the flow outlet opening towards a reverse side of the fixed scroll end plate, and an air passage opening for allowing part of the cooling air flowing through the scroll duct to flow into a space formed on a reverse side of the orbiting scroll end plate.

In the present invention, while an orbiting motion of the orbiting scroll is performed by means of the electric motor, the cooling fan can be rotated with the orbiting scroll. Thus, the cooling fan can be driven by utilizing the electric motor as a power source of the machine, and the electric motor and the cooling fan can be arranged in an axial direction of the rotary shaft. Therefore, a reduction in the number of parts, such as electric fans, can be achieved, thereby reducing costs. Further, generation of pronounced noise and a large amount of heat, and high power consumption due to the use of electric fans is avoided. Further, a radial dimension of the machine can be reduced while ensuring sufficiently high cooling performance.

Further, the cooling fan is capable of sucking cooling air into the casing through the flow inlet opening and discharging this cooling air through the flow outlet opening into the scroll duct. While supplying the cooling air flowing through the duct to the reverse side of the fixed scroll, part of the cooling air can be supplied to the reverse side of the orbiting scroll through the air passage opening.

Thus, the cooling air can be divided into two currents of air, which are then individually supplied to the fixed scroll and the orbiting scroll. It is possible to avoid a situation that, for example, the cooling air heated by cooling one scroll flows towards the other scroll. Therefore, each of the fixed scroll and the orbiting scroll can be efficiently cooled by cooling air having low temperature, to thereby achieve high cooling performance.

The present invention further provides a scroll type fluid machine comprising:

a fixed-side member including a casing and first and second fixed scrolls provided on opposite sides of the casing, each of the first and second fixed scrolls being formed by an end plate and a spiral wrap portion extending from a front surface of the end plate;

an electric motor provided in the casing between the first fixed scroll and the second fixed scroll;

a rotary shaft supported by the casing and adapted to be rotatably driven by the electric motor; and first and second orbiting scrolls connected to the rotary shaft at a position where the first and second orbiting scrolls face the first and second fixed scrolls, respectively, each of the first and second orbiting scrolls being formed by an end plate and a wrap portion extending from a front surface of the end plate, the wrap portion of the first orbiting scroll overlapping the wrap portion of the first fixed scroll, thereby forming a plurality of compression chambers, the wrap portion of the second orbiting scroll overlapping the wrap portion of the second fixed scroll, thereby forming a plurality of compression chambers, the rotary shaft being provided with first and second cooling fans accommodated in the fixed-side member on axially opposite sides of the rotary shaft, the first and second cooling fans being adapted to rotate with the rotary shaft at a position where the cooling fans face the first and second orbiting scrolls, respectively, the fixed-side member being provided with flow inlet openings for sucking cooling air along reverse sides of the end plates of the first and second orbiting scrolls during rotation of the first and second cooling fans, flow outlet openings for allowing the cooling air sucked from the flow inlet openings to be discharged from the fixed-side member by operation of the first and second cooling fans, and scroll ducts for guiding the cooling air discharged from the flow outlet openings towards reverse sides of the end plates of the first and second fixed scrolls.

In the present invention, while orbiting motions of the first and second orbiting scrolls are performed by means of the electric motor, the first and second cooling fans can be rotated with the first and second orbiting scrolls. Therefore, the cooling fans are capable of sucking cooling air from the flow inlet openings along the reverse sides of the first and second orbiting scrolls, thus efficiently cooling the end plates of the orbiting scrolls. The cooling fans are also capable of discharging the cooling air through the flow outlet openings into the scroll ducts, to thereby efficiently cool the end plates of the first and second fixed scrolls.

Thus, the two cooling fans can be driven by utilizing the electric motor as a power source of the machine. Differing from the prior art, in the present invention it is not necessary to use two electric fans. Therefore, a reduction in the number of parts, such as electric fans, can be achieved, thereby reducing costs. Further, generation of pronounced noise and a large amount of heat, and high power consumption due to the use of electric fans is also avoided.

Since the cooling fans can be provided on axially opposite sides of the rotary shaft, a radial dimension of the machine can be reduced. Further, without complicating the structures of the casing and the orbiting scrolls, cooling performance can be increased over wide areas on opposite sides of the casing. Therefore, even in the scroll type fluid machine having two compression portions, a simple structure for cooling can be employed, so that an operation for assembly can be efficiently conducted.

The present invention further provides a scroll type fluid machine comprising:

a fixed-side member including a casing and first and second fixed scrolls provided on opposite sides of the casing, each of the first and second fixed scrolls being formed by an end plate and a spiral wrap portion extending from a front surface of the end plate;

an electric motor provided in the casing between the first fixed scroll and the second fixed scroll;

a rotary shaft supported by the casing and adapted to be rotatably driven by the electric motor; and first and second orbiting scrolls connected to the rotary shaft at a position where the first and second orbiting scrolls face the first and second fixed scrolls, respectively, each of the first and second orbiting scrolls being formed by an end plate and a wrap portion extending from a front surface of the end plate, the wrap portion of the first orbiting scroll overlapping the wrap portion of the first fixed scroll, thereby forming a plurality of compression chambers, the wrap portion of the second orbiting scroll overlapping the wrap portion of the second fixed scroll, thereby forming a plurality of compression chambers, the rotary shaft being provided with first and second cooling fans accommodated in the fixed-side member on axially opposite sides of the rotary shaft, the first and second cooling fans being adapted to rotate with the rotary shaft at a position where the first and second cooling fans face the first and second orbiting scrolls, respectively, the fixed-side member being provided with a first flow inlet opening for sucking cooling air along a reverse side of the end plate of the first orbiting scroll during rotation of the first cooling fan, a first flow outlet opening for allowing the cooling air sucked from the first flow inlet opening to be discharged from the fixed-side member by operation of the first cooling fan, and a first scroll duct for guiding the cooling air discharged from the first flow outlet opening towards a reverse side of the end plate of the first fixed scroll, the fixed-side member being further provided with a second flow inlet opening for sucking cooling air into the casing during rotation of the second cooling fan, a second flow outlet opening for allowing the cooling air sucked from the second flow inlet opening to be discharged from the fixed-side member by operation of the second cooling fan, a second scroll duct for guiding the cooling air discharged from the second flow outlet opening towards a reverse side of the end plate of the second fixed scroll, and an air passage opening for allowing part of the cooling air flowing through the second scroll duct to flow into a space formed on a reverse side of the end plate of the second orbiting scroll.

In the present invention, while orbiting motions of the first and second orbiting scrolls are performed by means of the electric motor, the first and second cooling fans can be rotated with the first and second orbiting scrolls. Therefore, the two cooling fans can be driven by utilizing the electric motor as a power source of the machine, and the electric motor and the cooling fans can be arranged in an axial direction of the rotary shaft. Therefore, a reduction in the number of parts, such as electric fans, can be achieved, thereby reducing costs. Further, generation of pronounced noise and a large amount of heat, and high power consumption due to the use of electric fans is also avoided. Further, a radial dimension of the machine can be reduced, while cooling performance can be increased over wide areas on opposite sides of the casing. Therefore, even in the scroll type fluid machine having two compression portions, a simple structure for cooling can be employed, so that an operation for assembly can be efficiently conducted.

Further, the first cooling fan is capable of sucking cooling air from the flow inlet opening along the reverse side of the orbiting scroll, and supplying this cooling air towards the reverse side of the fixed scroll. Thus, both the fixed scroll and the orbiting scroll can be cooled in series by using a single current of cooling air. Therefore, a cooling structure for cooling the two scrolls can be simplified.

The second cooling fan is capable of supplying cooling air flowing through the duct to the reverse side of the fixed scroll, while supplying part of this cooling air to the reverse side of the orbiting scroll through the air passage opening. Thus, the cooling air can be divided into two currents of air, which are then individually supplied to the fixed scroll and the orbiting scroll. Therefore, the fixed scroll and the orbiting scroll can be simultaneously cooled with high efficiency by means of low-temperature cooling air, to thereby achieve high cooling performance. Thus, in a scroll type fluid machine comprising two compression portions, different cooling structures can be employed for each of the two compression portions.

The scroll type fluid machine may be arranged, such that:

a partition plate is provided in the fixed-side member so as to provide a partition between the orbiting scroll and the cooling fan;

the flow inlet opening is disposed on a side of the orbiting scroll relative to the partition plate; and the flow outlet opening is disposed on a side opposite to the flow inlet opening relative to the partition plate.

By means of the partition plate provided between the orbiting scroll and the cooling fan, a space on a side of the orbiting scroll and a space on a side of the cooling fan can be divided, with the flow inlet opening that opens into the space on a side of the orbiting scroll and the flow outlet opening that opens into the space on a side of the cooling fan.

By forming an opening in the partition plate, during operation of the cooling fan, cooling air sucked from the flow inlet opening along the reverse side of the orbiting scroll due to rotation of the cooling fan can be discharged from the casing through the flow outlet opening. Thus, with a simple structure using a partition plate, a cooling air passage facing the orbiting scroll and the cooling fan can be formed, thereby enabling a stable operation for cooling the orbiting scroll and the like.

The scroll type fluid machine may be arranged, such that:

two partition plates, one of which provides a partition between the electric motor and the cooling fan and the other of which provides a partition between the cooling fan and the orbiting scroll, are provided in the fixed-side member;

the flow inlet opening is disposed on a side of the electric motor relative to said one partition plate;

the flow outlet opening is disposed between said one partition plate and said other partition plate; and the air passage opening is disposed on a side of the orbiting scroll relative to said other partition plate.

With this arrangement, by means of the two partition plates an inner space of the casing can be divided into 3 spaces arranged in an axial direction, with the flow inlet opening that opens into the space on a side of the motor, and the flow outlet opening that opens into the space accommodating the cooling fan. The air passage opening can be formed so as to open into the space on a side of the orbiting scroll.

Therefore, when the cooling fan is operated, the cooling air sucked through the flow inlet opening into the casing, the cooling air flowing through the flow outlet opening into the scroll duct and discharged to the reverse side of the fixed scroll, and the cooling air flowing through the air passage opening to the reverse side of the orbiting scroll, are not mixed with each other, thus reliably separating the three currents of cooling air by means of the partition plates. Therefore, currents of cooling air can be stably formed by a simple structure using the partition plates.

The scroll type fluid machine may be arranged, such that:

a cooling device is provided outside the fixed-side member, the cooling device being adapted to cool a gas sucked into the compression chambers or a gas discharged from the compression chambers;

the flow outlet opening is formed at each of two positions in the fixed-side member which are different from a position of the flow inlet opening; and the flow outlet opening formed at one of the two positions is connected to the scroll duct, and the flow outlet opening formed at the other position is connected to a cooling device duct for guiding cooling air into the cooling device.

With this arrangement, during a machine operation, the cooling device is capable of cooling a gas sucked into the compression chambers or a compressed gas discharged from the compression chambers, thus increasing efficiency of compression of the gas or enabling the compressed gas to be dehumidified. Part of the cooling air sucked from the flow inlet opening can be discharged from one flow outlet opening into the scroll duct, and the remaining part of the cooling air can be discharged from the other flow outlet opening into the cooling device duct.

Therefore, the fixed scroll, the orbiting scroll and the cooling device can be efficiently cooled, thus increasing cooling performance of the machine.

The scroll type fluid machine may be arranged, such that:

the flow inlet opening and the flow outlet opening are formed at different positions;

a plurality of orbiting-side cooling fins are formed on the reverse side of the orbiting scroll end plate so as to extend in a direction of flow of cooling air flowing from the flow inlet opening; and a plurality of fixed-side cooling fins are formed on the reverse side of the fixed scroll end plate so as to extend in a direction of flow of cooling air guided from the flow outlet opening through the scroll duct.

With this arrangement, the flow inlet opening and the flow outlet opening can be disposed without interfering with each other. In this state, the cooling air sucked from the flow inlet opening can be flowed along the orbiting-side cooling fins, while the cooling air guided through the flow outlet opening to the reverse side of the fixed scroll can be flowed along the fixed-side cooling fins. Therefore, the fixed scroll and the orbiting scroll can be efficiently cooled.

DETAILED DESCRIPTION OF THE INVENTION

Hereinbelow, referring to the accompanying drawings, description is made in detail with regard to a scroll type fluid machine according to an embodiment of the present invention.

FIGS. 1 to 6 show a first embodiment of the present invention. In this embodiment, a scroll type air compressor of a twin wrap type is taken as an example.

Figure 1:
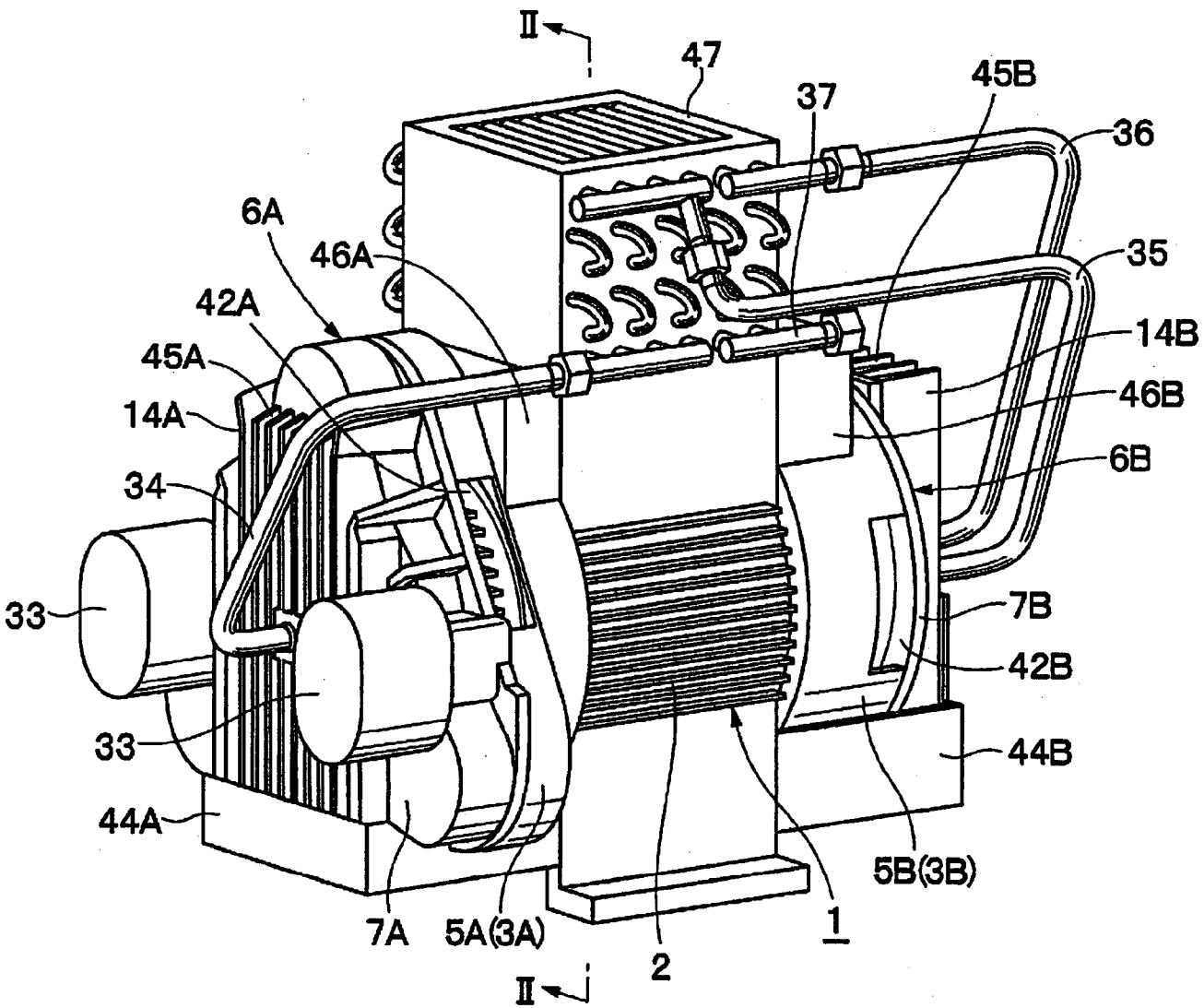
FIG. 1 is a perspective view showing an appearance of a scroll type air compressor according to a first embodiment of the present invention.
Figure 2:
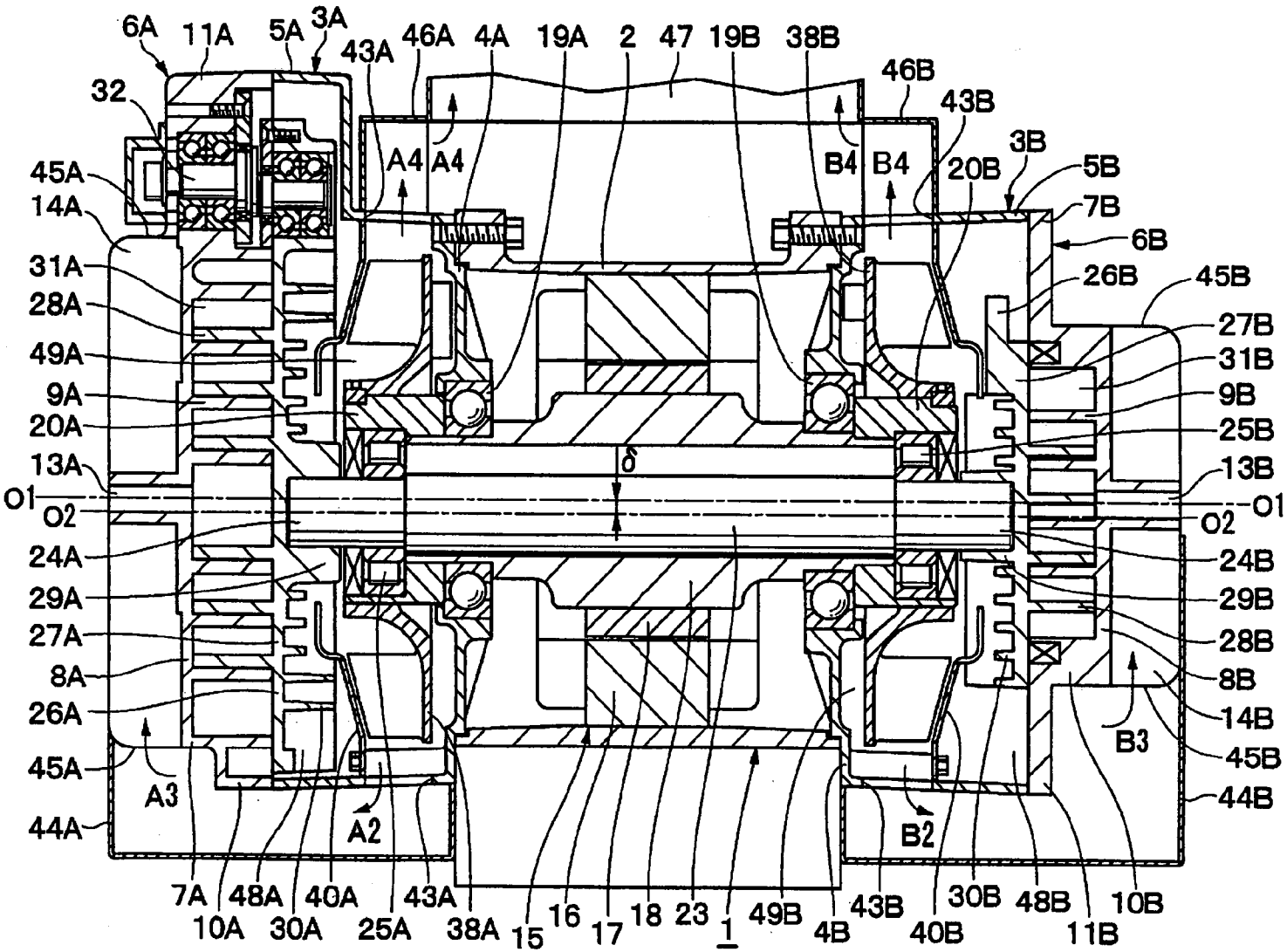
FIG. 2 shows a vertical section of the air compressor, taken along the line II-II in FIG. 1, as viewed in the direction of the appended arrows.

In the drawings, reference numeral 1 denotes a substantially cylindrical casing forming an outer frame of the scroll type air compressor. The casing 1, together with fixed scrolls 7A and 7B described later, forms a fixed-side member. As indicated in FIGS. 1 and 2, the casing 1 comprises an intermediate case 2 in a substantially cylindrical form, having a center axis O1-O1 and having axially opposing open ends (on a left side and a right side of the intermediate case in FIG. 2), and outer cases 3A and 3B attached to axially opposite ends of the intermediate case 2.

Figure 5:
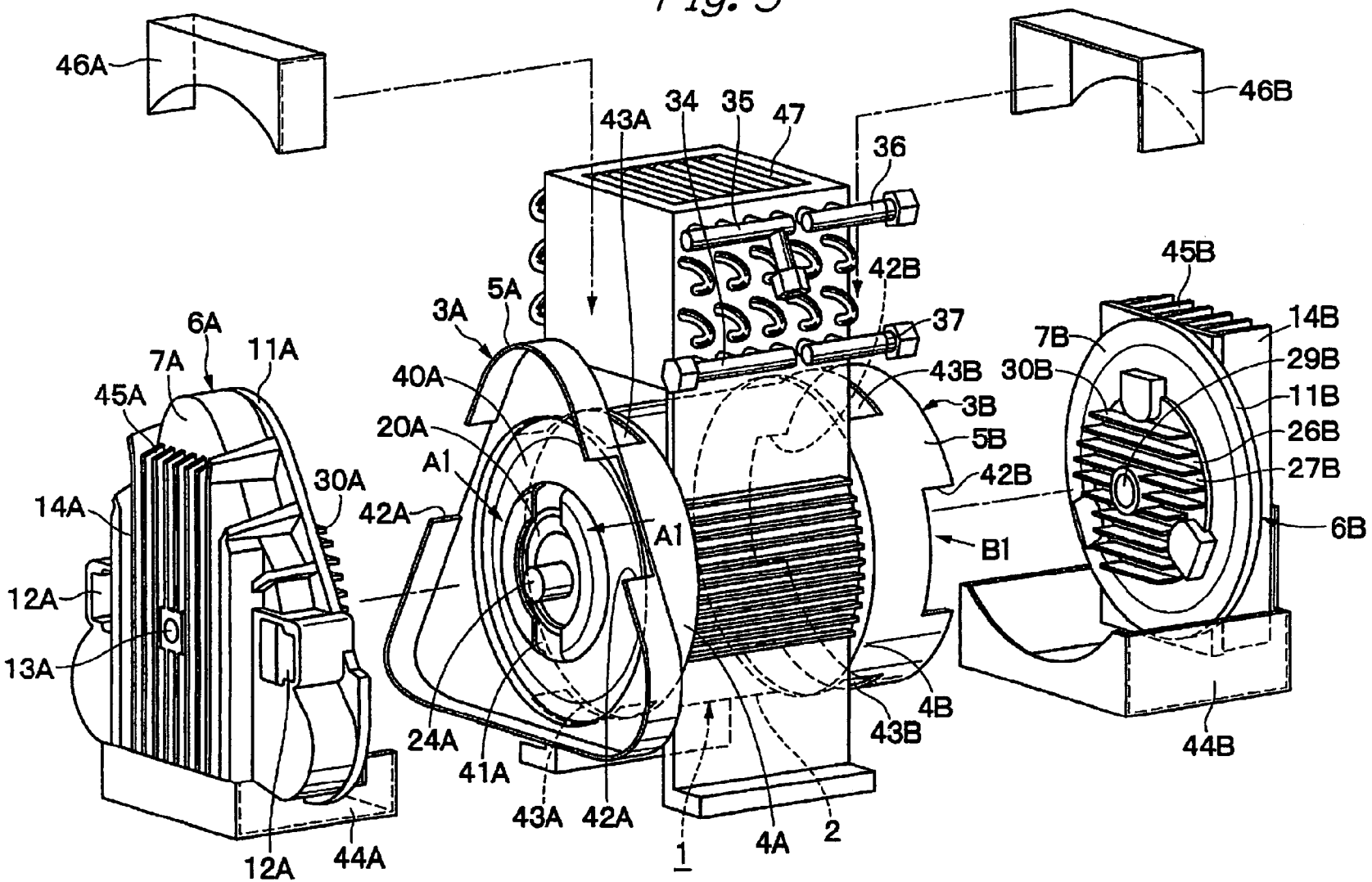
FIG. 5 is an exploded perspective view before the low-pressure-stage and high-pressure-stage compression portions are assembled.
Figure 6:
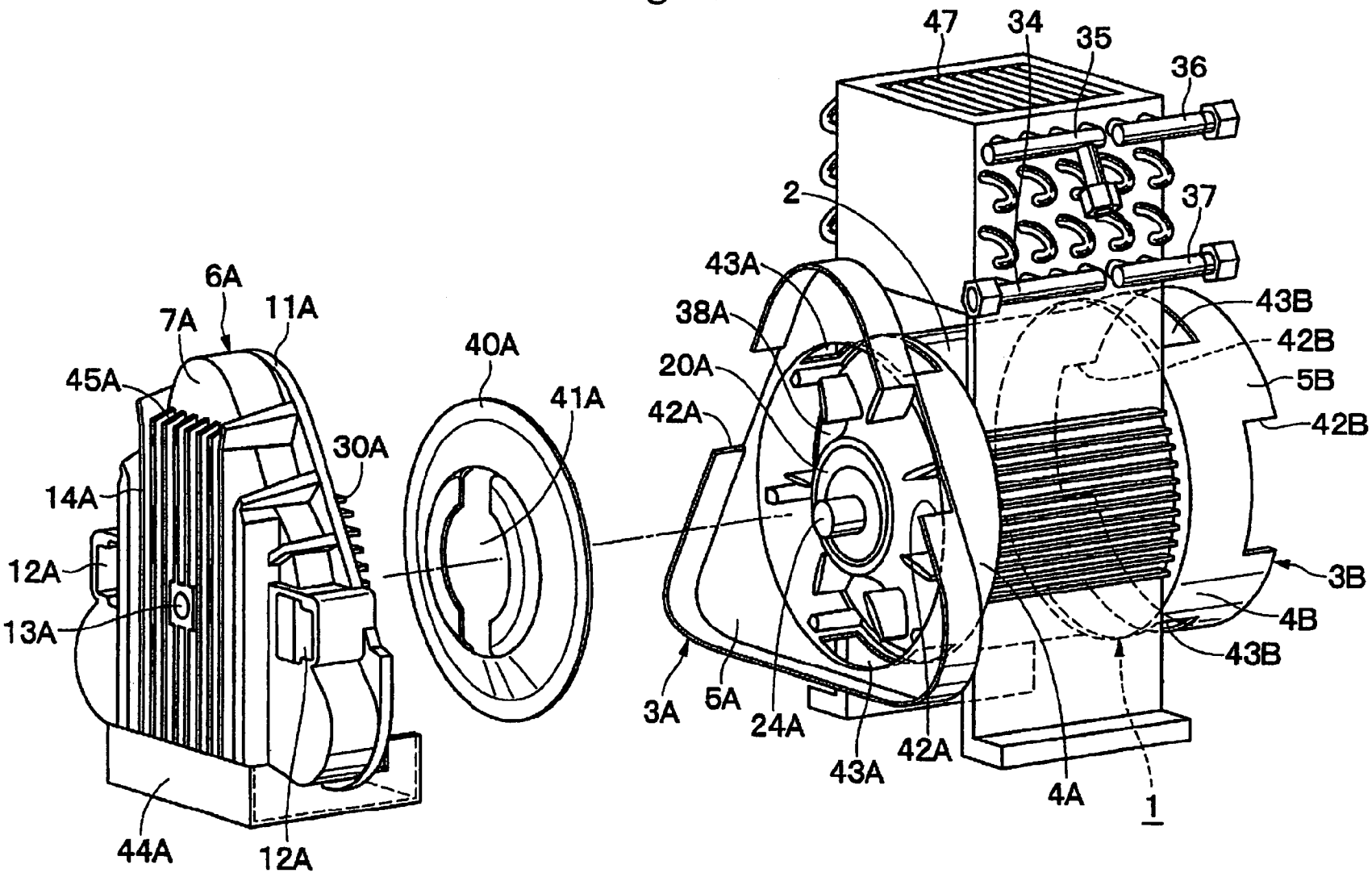
FIG. 6 is an exploded perspective view of the low-pressure-stage compression portion before a cooling fan, a partition plate and the like are assembled.

As shown in FIGS. 5 and 6, the first outer case 3A, which is located on one axial side (a left side in FIG. 2) of the intermediate case 2, is substantially in the form of a bottomed cylinder having axially opposing ends, one of which is open and the other of which is closed. The outer case 3A comprises a fan accommodating portion 4A in the form of a bottomed cylinder attached to one end of the intermediate case 2 by means of a screw or the like. The outer case 3A also comprises a scroll accommodating portion 5A formed at one end of the fan accommodating portion 4A. The scroll accommodating portion 5A is of a substantially tubular configuration, having a triangular cross-section that is diametrically enlarged from the fan accommodating portion 4A.

As shown in FIG. 5, the second outer case 3B, which is located on the other axial side of the intermediate case 2 (a right side in FIG. 2), is in the form of a bottomed cylinder having axially opposing ends, one of which is open and the other of which is closed. The outer case 3B comprises a fan accommodating portion 4B in the form of a bottomed cylinder having one end attached to the other end of the intermediate case 2, and a scroll accommodating portion 5B formed at the other end of the fan accommodating portion 4B.

The fan accommodating portions 4A and 4B of the outer cases 3A and 3B respectively accommodate cooling fans 38A and 38B, described later. The scroll accommodating portions 5A and 5B respectively accommodate orbiting scrolls 26A and 26B, described later.

The first outer case 3A, together with the first fixed scroll 7A and the first orbiting scroll 26A, described later, form a low-pressure-stage compression portion 6A. The second outer case 3B, together with the second fixed scroll 7B and the second orbiting scroll 26B, described later, form a high-pressure-stage compression portion 6B. The low-pressure-stage compression portion 6A and the high-pressure-stage compression portion 6B have substantially the same arrangements. Therefore, in the following description, the low-pressure-stage elements are designated by reference numerals appended with "A", and the high-pressure-stage elements are designated by reference numerals appended with "B". Regarding the high-pressure-stage elements, explanation overlapping that of the low-pressure-stage elements is omitted.

Figure 3:
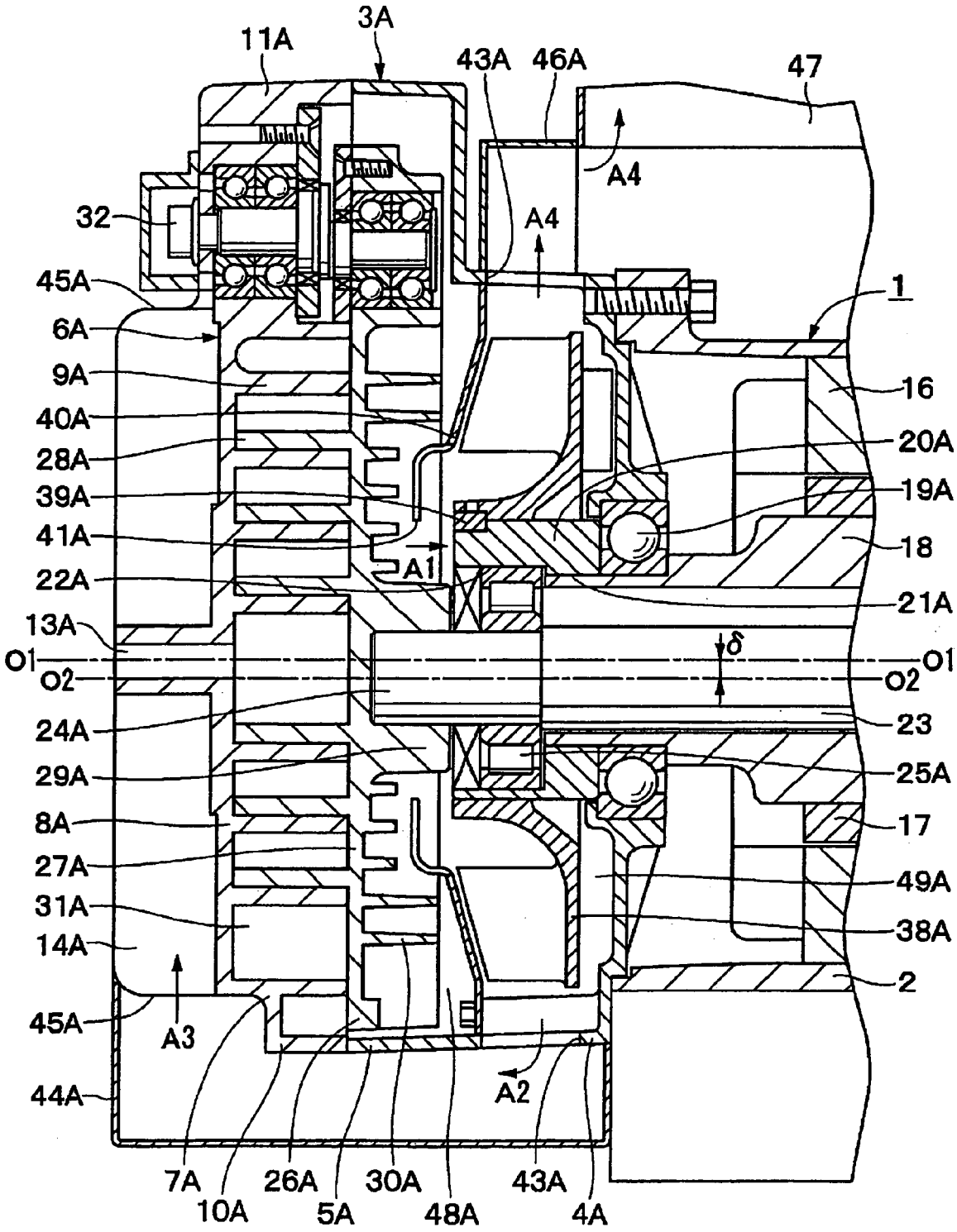
FIG. 3 is an enlarged cross-sectional view of an essential part of FIG. 2, showing a low-pressure-stage compression portion.

Reference numeral 7A denotes a low-pressure-stage fixed scroll provided at the open end of the outer case 3A of the casing 1. As shown in FIGS. 2 and 3, the fixed scroll 7A comprises a substantially disk-like end plate 8A disposed with a center axis thereof coincident with the axis O1-O1 of the casing 1. The fixed scroll 7A also comprises a spiral wrap portion 9A extending from a front surface of the end plate 8A, a tubular portion 10A projecting axially from an outer periphery of the end plate 8A so as to surround the wrap portion 9A, and a flange portion 11A projecting radially outward from an outer periphery of the tubular portion 10A and detachably attached to the open end of the outer case 3A by means of a bolt or the like.

As shown in FIG. 5, suction ports 12A are formed at two positions in an outer peripheral portion of the end plate 8A so as to suck fluid, such as air, into the compressor. A discharge port 13A for compressed air is formed in a central portion of the end plate 8A. A reverse side of the end plate 8A includes a plurality of fixed cooling fins 14A extending vertically in a direction of flow of cooling air (indicated by the arrow A3 in FIG. 2), which is described later.

Reference numeral 7B denotes a high-pressure-stage fixed scroll provided at the open end of the outer case 3B of the casing 1. Substantially, as in the case of the fixed scroll 7A, the fixed scroll 7B comprises an end plate 8B, a wrap portion 9B, a tubular portion 10B and a flange portion 11B, etc. A reverse side of the end plate 8B includes a plurality of fixed cooling fins 14B extending vertically in a direction of flow of cooling air (indicated by the arrow B3 in FIG. 2).

Reference numeral 15 denotes an electric motor provided in the intermediate case 2 of the casing 1. As shown in FIG. 2, the electric motor 15 is disposed between the low-pressure-stage fixed scroll 7A and the high-pressure-stage fixed scroll 7B, and comprises a cylindrical stator 16 fixed to an inner cylindrical surface of the intermediate case 2 and a cylindrical rotor 17 rotatably provided on an inner cylindrical surface of the stator 16. The electric motor 15 is adapted to rotate a rotary shaft 18, which is described later, about the axis O1-O1.

Reference numeral 18 denotes a rotary shaft rotatably provided in the casing 1. The rotary shaft 18 comprises, for example, a hollow cylindrical rod having a stepped configuration. An axially intermediate portion of the rotary shaft 18 is fitted into the rotor 17 of the electric motor 15, and is adapted to rotate with the rotor 17 about the axis O1-O1. Axially opposite ends of the rotary shaft 18 are rotatably supported by closed end portions of the outer cases 3A and 3B (the fan accommodating portions 4A and 4B) through rotation bearings 19A and 19B.

Reference numeral 20A denotes a substantially cylindrical eccentric bushing attached to one end of the rotary shaft 18. As shown in FIG. 3, a rotary shaft fitting hole 21A and a connecting shaft fitting hole 22A are formed in the eccentric bushing 20A. These holes are communicated with each other and extend in the axial direction.

The rotary shaft 18 is fitted into the rotary shaft fitting hole 21A and fixed therein by means of, for example, press-fitting, and thus the rotary shaft 18 and the eccentric bushing 20A are adapted to rotate as a unit. The connecting shaft fitting hole 22A has a larger diameter than the rotary shaft fitting hole 21A. The center axis of the connecting shaft fitting hole 22A is offset from the center axis of the rotary shaft fitting hole 21A (the axis O1-O1) by a distance δ (an offset value δ).

A connecting shaft 23 is rotatably fitted into the connecting shaft fitting hole 22A through an eccentric bearing 25A described later. Consequently, when the connecting shaft 23 is offset from the axis O1-O1 by the offset value δ, an outer circumferential surface of the eccentric bushing 20A can be configured, irrespective of the offset value δ (that is, a cylindrical form having a radius centered coincident with the axis O1-O1).

Figure 4:
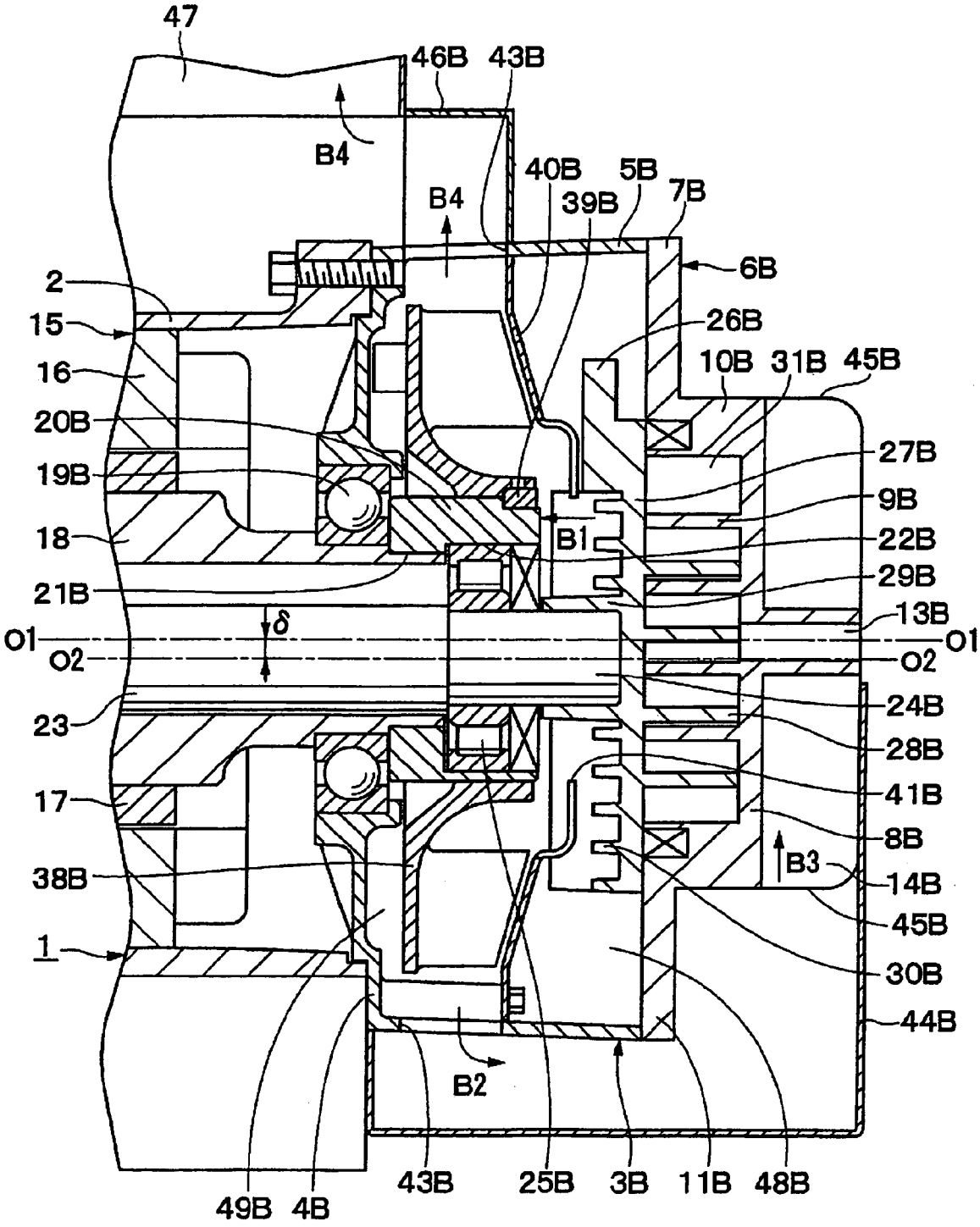
FIG. 4 is an enlarged cross-sectional view of an essential part of FIG. 2, showing a high-pressure-stage compression portion.

Reference numeral 20B denotes a substantially cylindrical eccentric bushing attached to the other end of the rotary shaft 18. As shown in FIG. 4, substantially as in the eccentric bushing 20A, the eccentric bushing 20B includes a rotary shaft fitting hole 21B and a connecting shaft fitting hole 22B.

Reference numeral 23 denotes a connecting shaft extending through the rotary shaft 18. As shown in FIG. 2, the connecting shaft 23 comprises a solid cylindrical rod having a stepped configuration, by way of example. Axially opposite ends of the connecting shaft 23 form solid cylindrical crank portions 24A and 24B which axially project from the rotary shaft 18. The crank portions 24A and 24B are connected to boss portions 29A and 29B of the orbiting scrolls 26A and 26B, which are described later.

The connecting shaft 23 is connected to the rotary shaft 18 through the eccentric bearings 25A and 25B and the eccentric bushings 20A and 20B in a manner such that the connecting shaft 23 is capable of rotating relative to the rotary shaft 18. An axis of rotation of the connecting shaft 23 is located on an offset axis O2-O2 that is offset from the axis O1-O1 of the rotary shaft 18 by the distance δ. When the rotary shaft 18 rotates, the connecting shaft 23, together with the orbiting scrolls 26A and 26B, performs an orbiting motion.

Reference numeral 26A denotes a low-pressure-stage, orbiting scroll, which is provided in the casing 1 so as to face the fixed scroll 7A and is capable of performing an orbiting motion. As shown in FIG. 3, the low-pressure-stage orbiting scroll 26A generally comprises a substantially disk-like end plate 27A, a spiral wrap portion 28A extending from a front surface of the end plate 27A and the cylindrical boss portion 29A extending from a reverse side of the end plate 27A.

Reference numeral 26B denotes a high-pressure-stage orbiting scroll provided facing the fixed scroll 7B. As shown in FIG. 4, substantially as in the low-pressure-stage orbiting scroll 26A, the orbiting scroll 26B generally comprises an end plate 27A, a wrap portion 28B and the boss portion 29B.

The end plates 27A and 27B are, respectively, accommodated in the scroll accommodating portions 5A and 5B of the outer cases 3A and 3B. A plurality of orbiting-side cooling fins 30A and a plurality of orbiting-side cooling fins 30B extend from the reverse sides of the end plates 27A and 27B, respectively. The cooling fins 30A and 30B horizontally extend substantially in a direction of flow of cooling air (the directions indicated by the arrows A1 and B1 in FIG. 5), so as to orthogonally intersect the fixed-side cooling fins 14A and 14B.

The wrap portions 28A and 28B overlap the wrap portions 9A and 9B of the fixed scrolls 7A and 7B with a predetermined angular displacement (for example, 180 degrees). Consequently, a plurality of compression chambers 31A arranged in a direction from the radially outer side to the radially inner side of the scrolls are formed between the low-pressure-stage wrap portions 9A and 28A. Similarly, a plurality of compression chambers 31B arranged in a direction from the radially outer side to the radially inner side of the scrolls are formed between the high-pressure-stage wrap portions 9B and 28B.

The boss portions 29A and 29B are integrally fixed to the crank portions 24A and 24B of the connecting shaft 23, respectively, by means of bolts (not shown) or the like. The orbiting scrolls 26A and 26B are driven through the rotary shaft 18 and the connecting shaft 23 by the electric motor 15, and perform orbiting motions with a predetermined orbiting radius corresponding to the offset value δ, thus compressing air in the compression chambers 31A and 31B. During the orbiting motion, each of the orbiting scroll 26A and the orbiting scroll 26B is prevented from rotating about its own axis by means of an auxiliary crank 32 (see FIG. 2).

As shown in FIG. 1, silencers 33 are connected to the low-pressure-stage suction ports 12A. Further, a pipe 34 is connected to the low-pressure-stage discharge port 13A, and the pipe 34 is connected through a cooling device 47 to a pipe 35. The pipe 35 is connected to a high-pressure-stage suction port (not shown).

Further, a pipe 36 is connected to a high-pressure-stage discharge port 13B. The pipe 36 is connected through the cooling device 47 to a pipe 37. The pipe 37 is connected to an external air tank (not shown). Thus, the air compressor in this embodiment is arranged as a two-stage type compressor in which air sucked through the silencers 33 is successively compressed in the low-pressure-stage compression portion 6A and the high-pressure-stage compression portion 6B.

Reference numeral 38A denotes a low-pressure-stage cooling fan as a first cooling fan provided on one axial side of the rotary shaft 18. As shown in FIGS. 3 and 6, the cooling fan 38A comprises a centrifugal fan, by way of example. The cooling fan 38A is fitted around the rotary shaft 18 through the eccentric bushing 20A and fixed to the eccentric bushing 20A using a key member 39A for preventing rotation. Further, in the casing 1, the cooling fan 38A is accommodated in the fan accommodating portion 4A of the outer case 3A, and disposed between the electric motor 15 and the low-pressure-stage orbiting scroll 26A.

Reference numeral 38B denotes a high-pressure-stage cooling fan as a second cooling fan provided on the other axial side of the rotary shaft 18. As shown in FIG. 4, the cooling fan 38B comprises a centrifugal fan having the same form as the cooling fan 38A, by way of example. The cooling fan 38B is attached to the rotary shaft 18 through the eccentric bushing 20B, and is accommodated in the fan accommodating portion 4B of the outer case 3B between the electric motor 15 and the high-pressure-stage orbiting scroll 26B.

The cooling fans 38A and 38B face the orbiting scrolls 26A and 26B, respectively, on axially opposite sides of the electric motor 15. At this position the cooling fans rotate with the rotary shaft 18, to thereby supply cooling air to the reverse sides of the fixed scrolls 7A and 7B, the reverse sides of the orbiting scrolls 26A and 26B and the cooling device 47 described later.

Reference numeral 40A denotes a low-pressure-stage partition plate as a first partition plate provided in the outer case 3A. The partition plate 40A comprises an annular plate made of a metal or a resin, by way of example. It is disposed to provide a partition between the low-pressure-stage orbiting scroll 26A and the low-pressure-stage cooling fan 38A (between the fan accommodating portion 4A and the scroll accommodating portion 5A).

The partition plate 40A includes an opening 41A at a central portion thereof, through which the boss portion 29A of the orbiting scroll 26A is inserted, with a gap being formed between the partition plate 40A and an outer periphery of the boss portion 29A. The opening 41A forms a communication passage between a space in the fan accommodating portion 4A and a space in the scroll accommodating portion 5A which are divided by the partition plate 40A.

Reference numeral 40B denotes a high-pressure-stage partition plate as a second partition plate provided in the outer case 3B. Substantially as in the partition plate 40A, the partition plate 40B comprises an annular plate made of a metal or a resin and includes an opening 41B at a central portion thereof. It is disposed to provide a partition between the high-pressure-stage orbiting scroll 26B and the high-pressure-stage cooling fan 38B (between the fan accommodating portion 4B and the scroll accommodating portion 5B).

Reference numeral 42A denotes a low-pressure-stage flow inlet opening as a first flow inlet opening formed in the scroll accommodating portion 5A of the outer case 3A. In this embodiment, the flow inlet openings 42A are formed at two positions in the scroll accommodating portion 5A, by way of example. As shown in FIGS. 1 and 5, each of the flow inlet openings 42A is formed between a cut portion at an open end of the scroll accommodating portion 5A and the flange portion 11A of the fixed scroll 7A. The flow inlet openings 42A are open at a surface of the scroll accommodating portion 5A on horizontally opposite sides (a left side and a right side) of the scroll accommodating portion 5A.

Reference numeral 42B denotes a high-pressure-stage flow inlet opening as a second flow inlet opening formed in the scroll accommodating portion 5B of the outer case 3B. In this embodiment, the flow inlet openings 42B are formed at two positions in the scroll accommodating portion 5B, by way of example. Substantially as in the low-pressure-stage flow inlet openings 42A, the flow inlet openings 42B are open at a side surface of the scroll accommodating portion 5B on horizontally opposite sides (a left side and a right side) of the scroll accommodating portion 5B.

When the cooling fans 38A and 38B are operated, external air is sucked through the flow inlet openings 42A and 42B into the scroll accommodating portions 5A and 5B and forms cooling air, which then flows in a substantially horizontal direction while cooling the reverse sides of the orbiting scrolls 26A and 26B.

Reference numeral 43A denotes a low-pressure-stage flow outlet opening as a first flow outlet opening formed in the fan accommodating portion 4A of the outer case 3A. In this embodiment, the flow outlet openings 43A are formed at two positions in the fan accommodating portion 4A, by way of example. The flow outlet openings 43A are open at a side surface of the fan accommodating portion 4A on vertically opposite sides (an upper side and a lower side) of the fan accommodating portion 4A. The flow inlet openings 42A and the flow outlet openings 43A are located on axially opposite sides of the partition plate 40A (a side on which the orbiting scroll 26A is provided and a side on which the cooling fan 38A is provided) in a spaced relationship and are formed at different positions in a circumferential direction of the outer case 3A.

Reference numeral 43B denotes a high-pressure-stage flow outlet opening as a second flow outlet opening formed in the fan accommodating portion 4B of the outer case 3B. In this embodiment, the flow outlet openings 43B are formed at two positions in the fan accommodating portion 4B, by way of example. Substantially as in the case of the low-pressure-stage flow outlet openings 43A, the flow outlet openings 43B are open at a side surface of the fan accommodating portion 4B on vertically opposite sides of the fan accommodating portion 4B. The flow outlet openings 43B and the flow inlet openings 42B are located on axially opposite sides of the partition plate 40B.

When the cooling fan 38A is operated, cooling air in the scroll accommodating portions 5A and 5B is sucked into the fan accommodating portions 4A and 4B through the openings 41A and 41B of the partition plates 40A and 40B. As indicated by the arrow A2 in FIG. 2, the cooling air which has been sucked into the fan accommodating portion 4A flows from the flow outlet openings 43A into ducts 44A and 46A, which are described later. As indicated by the arrow B2, the cooling air which has been sucked into the fan accommodating portion 4B flows from the flow outlet openings 43B into ducts 44B and 46B, which are described later.

Reference numeral 44A denotes a first (low-pressure-stage) scroll duct provided below the outer case 3A. The scroll duct 44A comprises, for example, a box-like member having a hollow structure. The duct 44A covers the lower-side flow outlet opening 43A and extends from this position to the position of lower-side fixed-scroll air passage openings 45A (the cooling fins 14A) described later, while connecting the flow outlet opening 43A and the air passage openings 45A.

Reference numeral 44B denotes a second (high-pressure-stage) scroll duct provided below the outer case 3B. Substantially as in the low-pressure-stage duct 44A, the scroll duct 44B covers the lower-side flow outlet opening 43B and extends from this position to the position of lower-side fixed-scroll air passage openings 45B described later, while connecting the flow outlet opening 43B and the air passage openings 45B.

The scroll ducts 44A and 44B guide cooling air that has been discharged from the lower-side flow outlet openings 43A and 43B toward the reverse sides of the fixed scrolls 7A and 7B, to thereby cool the end plates 8A and 8B.

Reference numeral 45A denotes first fixed-scroll air passage openings formed on each of vertically opposite sides of the low-pressure-stage fixed scroll 7A. The first fixed-scroll air passage openings 45A are formed at opposite ends of the fixed-side cooling fins 14A and are open on an outer surface side of the fixed scroll 7A. Due to the fixed-scroll air passage openings 45A, the cooling air that flows through the duct 44A is caused to flow along the fixed-side cooling fins 14A on the reverse side of the end plate 8A. Similarly, the second fixed-scroll air passage openings 45B are formed in the high-pressure-stage fixed scroll 7B.

Reference numeral 46A denotes a first (low-pressure-stage) cooling device duct connected to the outer case 3A. The cooling device duct 46A comprises, for example, a box-like member having a hollow structure. It covers the upper-side flow outlet opening 43A and is connected between the upper-side flow outlet opening 43A and the cooling device 47 described later.

Reference numeral 46B denotes a second (high-pressure-stage) cooling device duct connected to the outer case 3B. Substantially as in the low-pressure-stage duct 46A, the cooling device duct 46B is connected between the upper-side flow outlet opening 43B and the cooling device 47.

When the cooling fans 38A and 38B rotate, cooling air that has been discharged from the upper-side flow outlet openings 43A and 43B is guided through the two cooling device ducts 46A and 46B into the cooling device 47.

In FIG. 1, reference numeral 47 denotes a cooling device provided on an upper side of the casing 1 (the intermediate case 2). In the cooling device 47, the pipes 34, 35, 36 and 37 are provided in zigzag bent forms. Heat is dissipated from these pipes 34 to 37 due to cooling air from the cooling fans 38A and 38B. The cooling device 47 is, for example, arranged as a twin cooler comprising an intercooler and an aftercooler formed as one unit, the intercooler being adapted to cool compressed air having an intermediate pressure discharged from the low-pressure-stage compression chambers 31A and sucked into the high-pressure-stage compression chambers 31B, and the aftercooler being adapted to cool high-pressure compressed air discharged from the compression chambers 31B.

In FIG. 2, reference numeral 48A denotes a scroll-partition plate interspace formed between the scrolls 7A and 26A and the partition plate 40A in the low-pressure-stage outer case 3A. The scroll-partition plate interspace 48A faces the reverse side of the end plate 27A of the orbiting scroll 26A. The flow inlet openings 42A open into the scroll-partition plate interspace 48A.

Reference numeral 49A denotes a motor-partition plate interspace formed between the electric motor 15 and the partition plate 40A in the outer case 3A. The cooling fan 38A is accommodated in the motor-partition plate interspace 49A, and the flow outlet openings 43A open into the motor-partition plate interspace 49A. Similarly, in the high-pressure-stage outer case 3B, a scroll-partition plate interspace 48B and a motor-partition plate interspace 49B are formed by the partition plate 40B.

A twin wrap type scroll air compressor in this embodiment is arranged as described above. Next, an operation of this compressor is described.

When power is supplied to the electric motor 15, the rotary shaft 18 is rotated about the axis O1-O1 by means of the rotor 17. Due to this rotation of the rotary shaft 18, the connecting shaft 23, which is connected in an eccentric relationship to the rotary shaft 18, performs an orbiting motion. Consequently, the orbiting scrolls 26A and 26B connected to opposite ends of the connecting shaft 23 each perform an orbiting motion with an orbiting radius $\delta$, with respect to the fixed scrolls 7A and 7B.

As a result, in the low-pressure-stage compression portion 6A, while external air is sucked through the silencers 33 and the suction ports 12A formed at an outer peripheral portion of the fixed scroll 7A, the air is successively compressed in the compression chambers 31A. The thus compressed air having an intermediate pressure is discharged from the low-pressure-stage compression chambers 31A into the cooling device 47 through the discharge port 13A of the fixed scroll 7A and the pipe 34.

In the high-pressure-stage compression portion 6B, when the compressed air having an intermediate pressure in the low-pressure-stage compression portion 6A is supplied from the cooling device 47 through the pipe 35 into the suction port of the fixed scroll 7B, the compressed air is further compressed in the compression chambers 31B, and high-pressure compressed air is discharged from the discharge port 13B into the pipe 36. This compressed air is cooled in the cooling device 47, and supplied through the pipe 37 to an air tank for storage.

Next, description is made with regard to a flow of cooling air for cooling the air compressor. When the rotary shaft 18 rotates, the cooling fans 38A and 38B connected to an outer circumferential surface of the rotary shaft 18 are rotated and, due to the action of centrifugal force, air in the outer cases 3A and 3B is discharged through the flow outlet openings 43A and 43B. Then, external air is sucked as cooling air into the scroll-partition plate interspaces 48A and 48B through the flow inlet openings 42A and 42B at side surfaces of the outer cases 3A and 3B.

As indicated by the arrows A1 and B1 in FIGS. 3 to 5, the cooling air, when sucked into the scroll-partition plate interspaces 48A and 48B along the reverse sides of the orbiting scrolls 26A and 26B, flows substantially horizontally along the orbiting-side cooling fins 30A and 30B. Thus, the cooling air flows in contact with the end plates 27A and 27B and the orbiting-side cooling fins 30A and 30B over a long distance from radially outer portions to central portions (corresponding to the openings 41A and 41B) of the orbiting scrolls 26A and 26B. Therefore, the end plates 27A and 27B and the orbiting-side cooling fins 30A and 30B can be efficiently cooled.

Further, due to rotation of the cooling fans 38A and 38B, the cooling air is sucked through the openings 41A and 41B of the partition plates 40A and 40B into the motor-partition plate interspaces 49A and 49B, and is partially discharged through the lower-side flow outlet openings 43A and 43B into the scroll ducts 44A and 44B, as indicated by the arrows A2 and B2 in FIGS. 2, 3 and 4. Then, as indicated by the arrows A3 and B3, the cooling air which has flowed out of the scroll ducts 44A and 44B flows substantially vertically along the fixed-side cooling fins 14A and 14B, thus cooling the reverse sides of the end plates 8A and 8B of the fixed scrolls 7A and 7B.

As indicated by the arrows A4 and B4, part of the cooling air which has been sucked into the motor-partition plate interspaces 49A and 49B is discharged through the upper-side flow outlet openings 43A and 43B into the cooling device ducts 46A and 46B. The cooling air is guided by the cooling device ducts 46A and 46B and passes through the cooling device 47, to thereby cool the intermediate-pressure compressed air sucked into the high-pressure-stage compression portion 6B and the high-pressure compressed air discharged from the compression portion 6B.

As has been described above, in this embodiment of the present invention, first and second cooling fans 38A and 38B are provided on axially opposite sides of the rotary shaft 18 so as to face the first and second orbiting scrolls 26A and 26B. The outer cases 3A and 3B of the casing 1 are provided with first and second flow inlet openings 42A and 42B, first and second flow outlet openings 43A and 43B, first and second scroll ducts 44A and 44B and first and second cooling device ducts 46A and 46B corresponding to these cooling fans 38A and 38B.

Therefore, during compressor operation, when the first and second orbiting scrolls 26A and 26B are subject to an orbiting motion by driving the rotary shaft 18 by means of the electric motor 15, the two cooling fans 38A and 38B can be rotated with the orbiting scrolls 26A and 26B in a face-to-face relationship to the orbiting scrolls 26A and 26B.

Consequently, as indicated by the arrows A1 and B1 in FIG. 5, the cooling fans 38A and 38B are capable of sucking cooling air from the flow inlet openings 42A and 42B along the reverse sides of the orbiting scrolls 26A and 26B, and the end plates 27A and 27B of the orbiting scrolls 26A and 26B can be cooled efficiently by means of the cooling air.

Further, the currents of cooling air can be discharged from the flow outlet openings 43A and 43B into the scroll ducts 44A and 44B and guided towards the reverse sides of the fixed scrolls 7A and 7B. Therefore, as indicated by the arrows A3 and B3 in FIG. 2, the end plates 8A and 8B of the fixed scrolls 7A and 7B can be also efficiently cooled.

Thus, the cooling fans 38A and 38B can be driven by utilizing the electric motor 15 as a power source of the compressor. Differing from the prior art, in the present invention it is not necessary to use two electric fans. Therefore, a reduction in the number of parts, such as electric fans, can be achieved, thereby reducing costs. Further, generation of pronounced noise and a large amount of heat, and high power consumption due to the use of electric fans is also avoided.

Since the cooling fans 38A and 38B can be provided on axially opposite sides of the electric motor 15, there is no need to provide a component such as an electric motor on a radially outer side of the casing 1 and therefore a radial dimension of the compressor can be reduced. Further, without complicating the structures of the casing 1 and the orbiting scrolls 26A and 26B, cooling performance can be increased over wide areas on axially opposite sides of the casing 1. Therefore, even in the air compressor having two compression portions 6A and 6B, a simple structure for cooling can be employed, so that an operation for assembly can be efficiently conducted.

Further, the cooling device 47 is provided on an upper side of the casing 1, and the flow inlet openings 42A and 42B are formed at side surfaces of the outer cases 3A and 3B of the casing 1, with the flow outlet openings 43A and 43B being formed on an upper side and a lower side of the outer cases 3A and 3B. The lower-side flow outlet openings 43A and 43B are connected to the scroll ducts 44A and 44B, and the upper-side flow outlet openings 43A and 43B are connected to the cooling device ducts 46A and 46B.

Therefore, the cooling device 47 is capable of cooling the intermediate-pressure compressed air sucked into the high-pressure-stage compression portion 6B and the high-pressure compressed air discharged from the compression portion 6B, thereby increasing efficiency of compression and enabling compressed air to be dehumidified. Therefore, performance of the compressor can be increased.

During operation of the cooling fans 38A and 38B, while cooling air is sucked along the reverse sides of the orbiting scrolls 26A and 26B through the flow inlet openings 42A and 42B at the side surfaces of the cooling fans, part of the cooling air can be flowed out of the lower-side flow outlet openings 43A and 43B into the scroll ducts 44A and 44B, and the remaining part of the cooling air can be flowed out of the upper-side flow outlet openings 43A and 43B into the cooling device ducts 46A and 46B. Thus, the fixed scrolls 7A and 7B, the orbiting scrolls 26A and 26B and the cooling device 47 can be efficiently cooled, thus increasing cooling performance of the compressor.

In this case, the flow inlet openings 42A and 42B, the lower-side flow outlet openings 43A and 43B (the scroll ducts 44A and 44B) and the upper-side flow outlet openings 43A and 43B (the cooling device ducts 46A and 46B) are disposed at different positions in a circumferential direction of the outer cases 3A and 3B. Therefore, there is no need to provide the ducts 44A, 44B, 46A and 46B while avoiding the flow inlet openings 42A and 42B. Therefore, ducts having simple configurations can be employed, while the flow inlet openings 42A and 42B can be made sufficiently large.

Further, the cooling device 47 and the ducts 44A, 44B, 46A and 46B are overlappingly disposed on an upper side and a lower side of the casing 1. Therefore, the compressor can be easily reduced in size with respect to a horizontal direction. Even when a compressor comprises a plurality of ducts and the cooling device 47, an area for installment of the compressor can be made small.

Further, in the outer cases 3A and 3B, the annular partition plate 40A having the central opening 41A is provided between the fan accommodating portion 4A and the scroll accommodating portion 5A, while the annular partition plate 40B having the central opening 41B is provided between the fan accommodating portion 4B and the scroll accommodating portion 5B. Therefore, a space in the fan accommodating portion 4A and a space in the scroll accommodating portion 5A can be divided by the partition plate 40A, while a space in the fan accommodating portion 4B and a space in the scroll accommodating portion 5B can be divided by the partition plate 40B. In this state, the flow inlet openings 42A and 42B open into the scroll accommodating portions 5A and 5B, respectively, while the flow outlet openings 43A and 43B open into the fan accommodating portions 4A and 4B, respectively.

By these arrangements, during operation of the cooling fans, cooling air can be sucked over a long distance from the flow inlet openings 42A and 42B to central portions (corresponding to the openings 41A and 41B) of the reverse sides of the orbiting scrolls 26A and 26B. Thus, the cooling air is capable of making contact with the end plates 27A and 27B and the cooling fins 30A and 30B of the orbiting scrolls 26A and 26B over long distances. Thus, cooling-air passages facing the orbiting scrolls 26A and 26B and the cooling fans 38A and 38B can be formed by means of a simple structure using the partition plates 40A and 40B, and cooling the orbiting scrolls 26A and 26B can be stably conducted.

On the other hand, vertical fixed-side cooling fins 14A and 14B are provided on the reverse sides of the end plates 8A and 8B of the fixed scrolls 7A and 7B, while horizontal orbiting-side cooling fins 30A and 30B are provided on the reverse sides of the end plates 27A and 27B of the orbiting scrolls 26A and 26B. Therefore, cooling air which has been sucked through the flow inlet openings 42A and 42B formed at side surfaces can be flowed horizontally along the orbiting-side cooling fins 30A and 30B, and cooling air which has been guided from the lower-side flow outlet openings 43A and 43B to the areas below the reverse sides of the fixed scrolls 7A and 7B can be flowed upwardly along the fixed-side cooling fins 14A and 14B. Therefore, the fixed scrolls 7A and 7B and the orbiting scrolls 26A and 26B can be cooled more efficiently.

The casing 1 is formed by three members, namely, the intermediate case 2 and the outer cases 3A and 3B. Therefore, the first fixed scroll 7A, the first orbiting scroll 26A and the first cooling fan 38A can be disposed in the outer casing 3A while the second fixed scroll 7B, the second orbiting scroll 26B and the second cooling fan 38B can be disposed in the outer casing 3B. Thus, the casing 1 can be made simple in structure, and an operation for assembling the compressor can be conducted efficiently.

The eccentric bushings 20A and 20B are provided on opposite ends of the rotary shaft 18. The connecting shaft 23 is provided on the inner circumferential surfaces of the eccentric bushings 20A and 20B through the eccentric bearings 25A and 25B. Therefore, the outer circumferential surfaces of the eccentric bushings 20A and 20B can be easily formed as cylindrical surfaces having center axes coincident with the axis O1-O1, regardless of the offset value δ of the connecting shaft 23, and the cooling fans 38A and 38B can be attached to these cylindrical surfaces for stable rotation.

In this case, when the rotary shaft 18 rotates in one direction, the direction of rotation of the cooling fan 38A as viewed from the compression portion 6A and the direction of rotation of the cooling fan 38B as viewed from the compression portion 6B become opposite to each other. However, each of the cooling fans 38A and 38B is formed as a centrifugal fan, which is capable of rotating in either direction to produce a current of air. Therefore, the cooling fan 38A and the cooling fan 38B can be formed to be identical to each other, so that the components of the compressor are less diversified, leading to a reduction in cost and high productivity.

Next, referring to FIGS. 7 to 11, a second embodiment of the present invention is described. A characteristic feature of this embodiment resides in that the compression portion on the low-pressure side and the compression portion on the high-pressure side have different cooling structures. In this embodiment, the same elements as those in the first embodiment are designated by the same reference numerals, and overlapping explanation is omitted.

Figure 7:
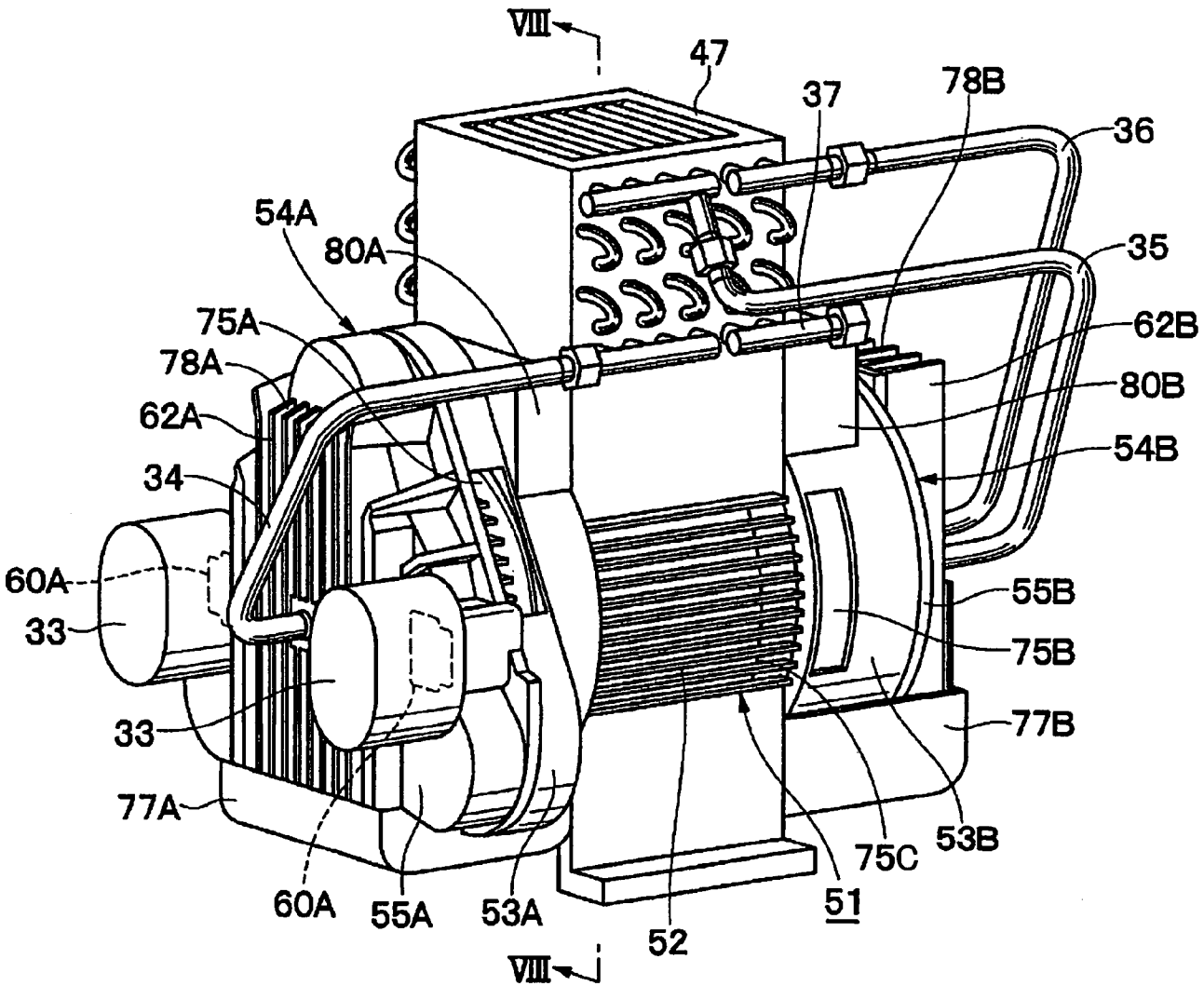
FIG. 7 is a perspective view showing an appearance of a scroll type air compressor according to a second embodiment of the present invention.
Figure 8:
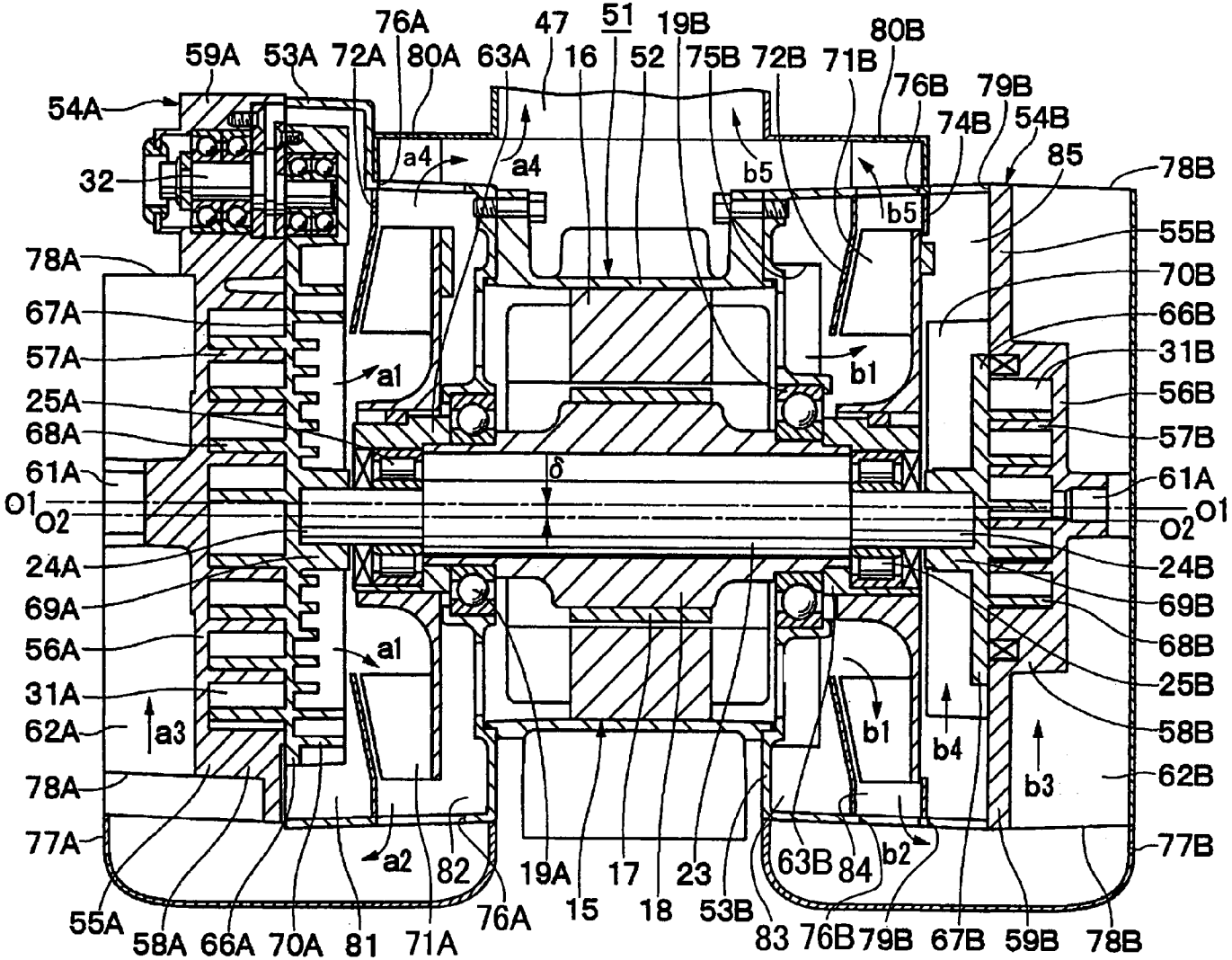
FIG. 8 shows a vertical section of the air compressor, taken along the line VIII-VIII in FIG. 7, as viewed in the direction of the appended arrows.

Reference numeral 51 denotes a casing which, together with fixed scrolls 55A and 55B described later, form a fixed-side member. As indicated in FIGS. 7 and 8, substantially as in the first embodiment, the casing 51 comprises a substantially cylindrical intermediate case 52 having axially opposing open ends, and first and second outer cases 53A and 53B each in the form of a bottomed cylinder. The first and second outer cases 53A and 53B have respective bottom portions thereof attached to axially opposite ends of the intermediate case 52.

The first outer case 53A, together with the first fixed scroll 55A and a first orbiting scroll 66A described later, form a low-pressure-stage compression portion 54A. The second outer case 53B, together with the second fixed scroll 55B and a second orbiting scroll 66B, form a high-pressure-stage compression portion 54B.

Figure 9:
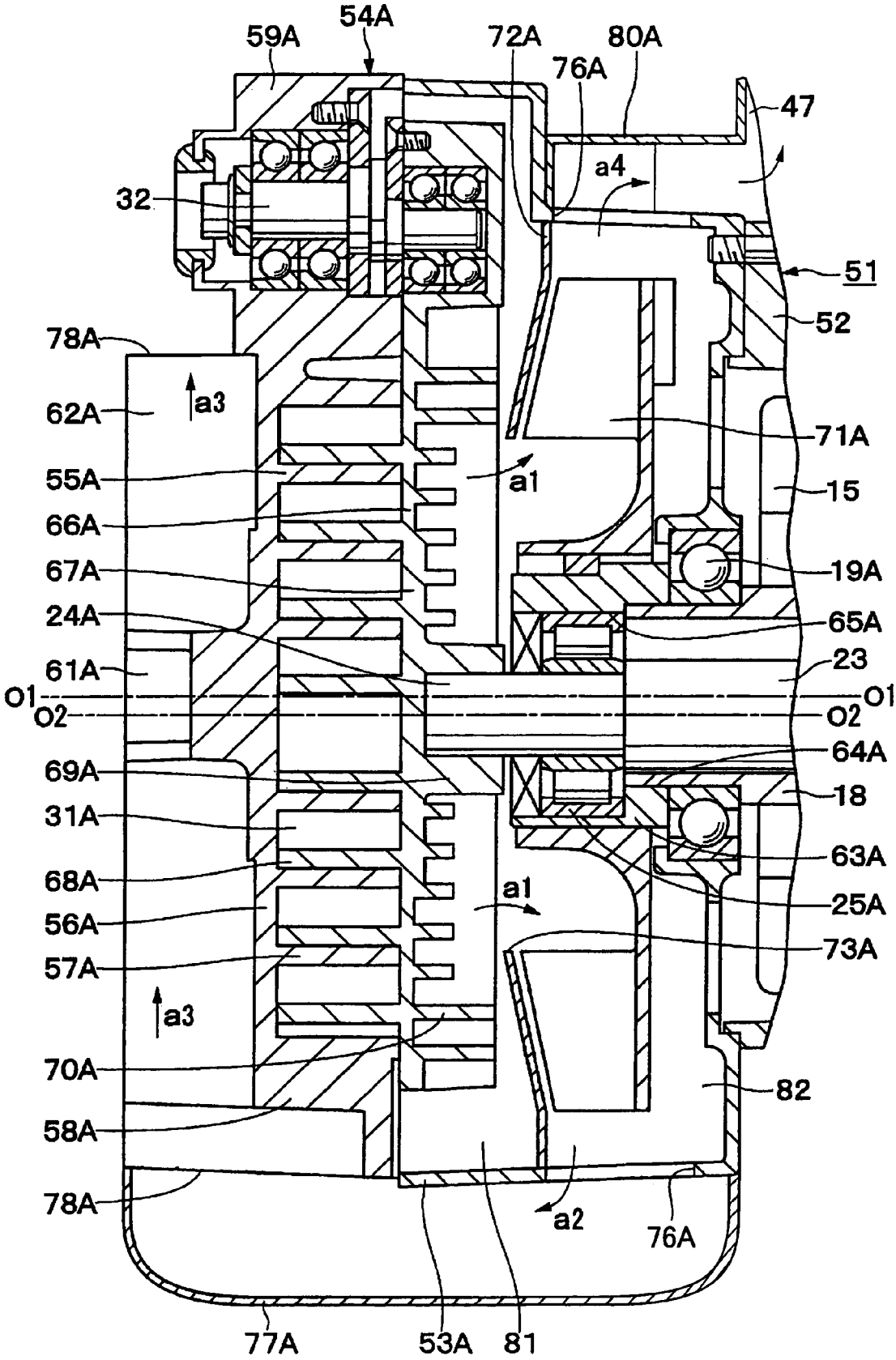
FIG. 9 is an enlarged cross-sectional view of an essential part of FIG. 8, showing a low-pressure-stage compression portion.

Reference numeral 55A denotes a low-pressure-stage fixed scroll attached to the outer case 53A. As indicated in FIG. 9, substantially as in the first embodiment, the fixed scroll 55A comprises an end plate 56A, a wrap portion 57A, a tubular portion 58A, a flange portion 59A, suction ports 60A (see FIG. 7), a discharge port 61A, fixed-side cooling fins 62A, etc.

Figure 10:
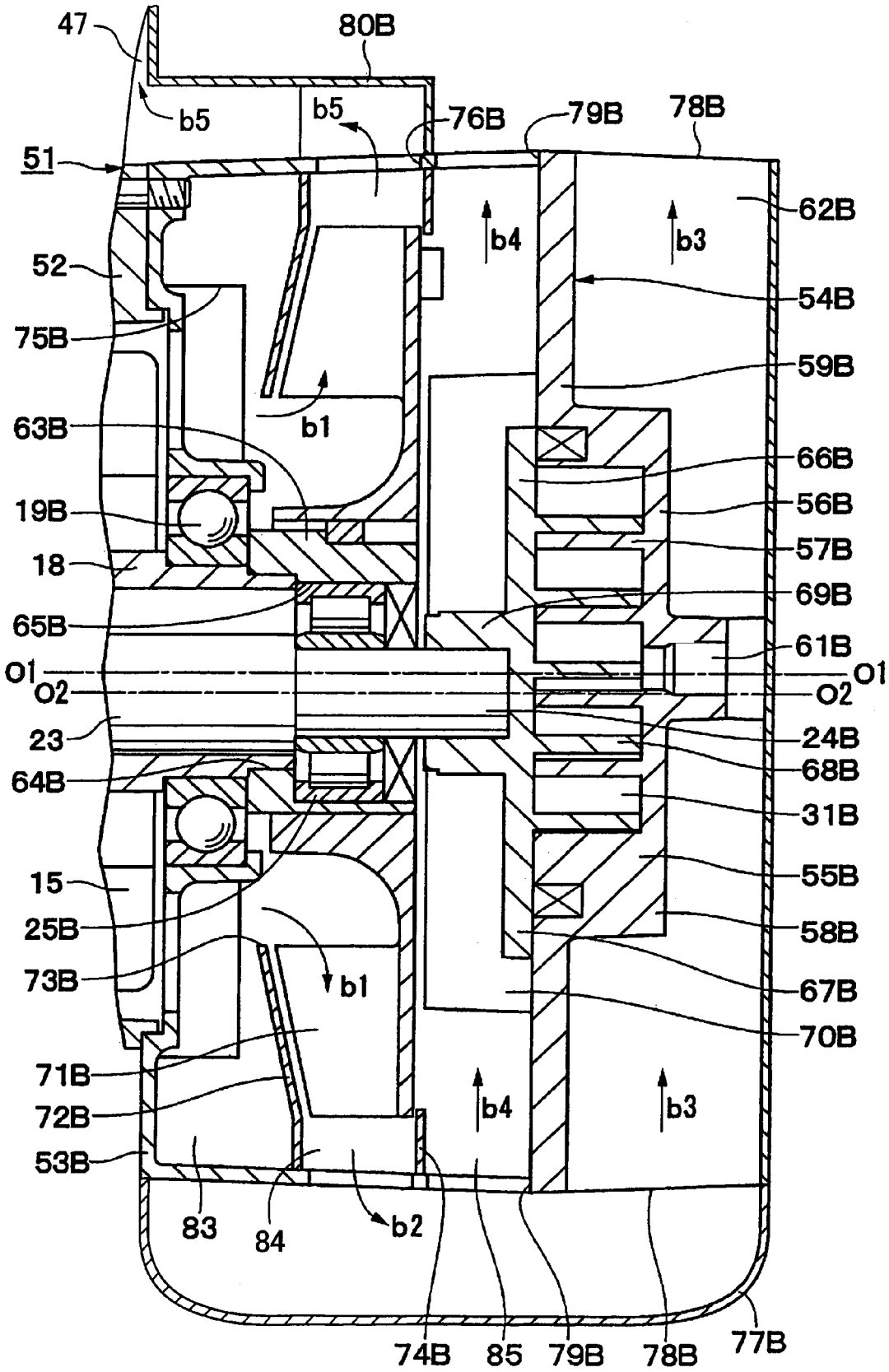
FIG. 10 is an enlarged cross-sectional view of an essential part of FIG. 8, showing a high-pressure-stage compression portion.
Figure 11:
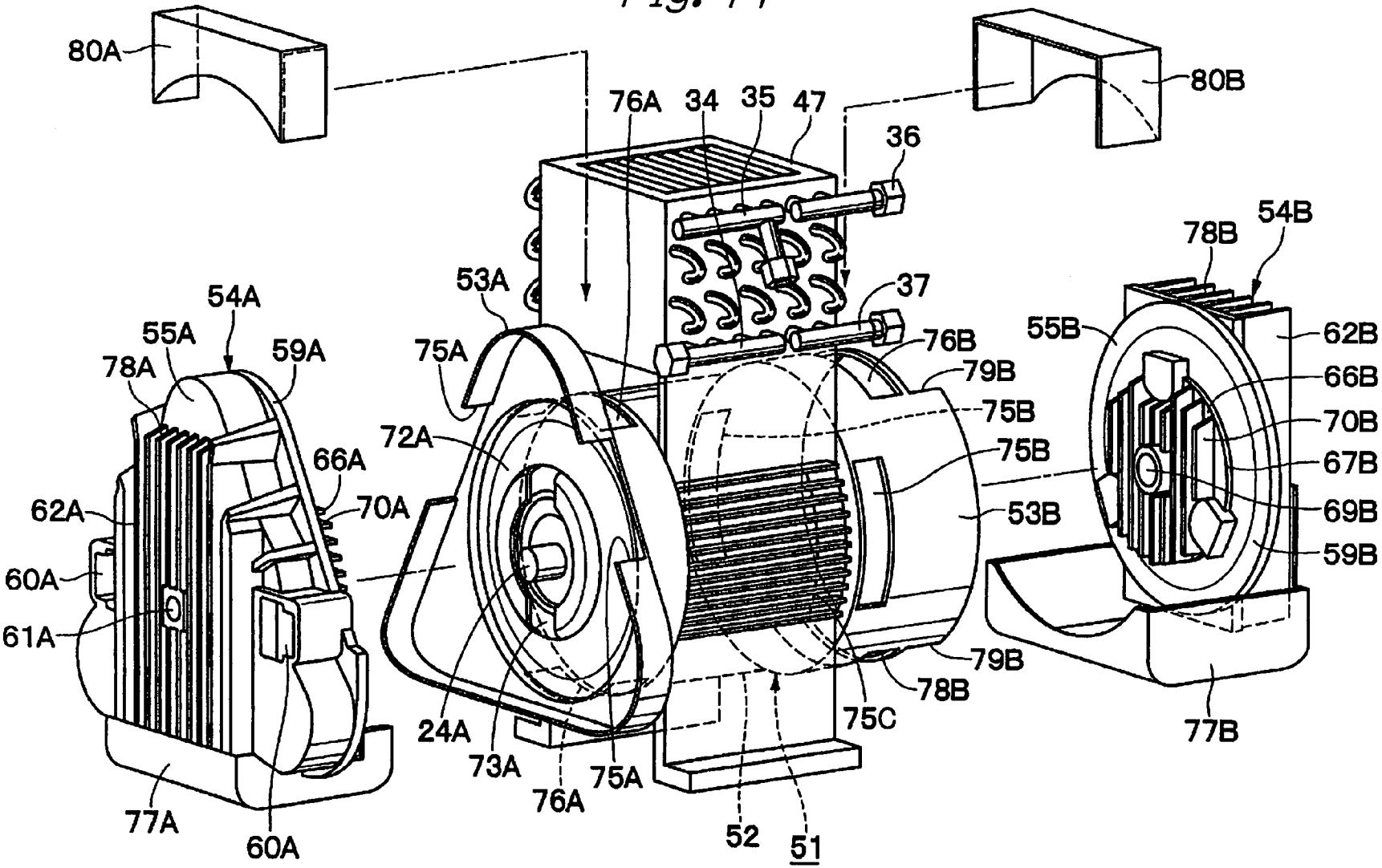
FIG. 11 is an exploded perspective view before the low-pressure-stage and high-pressure-stage compression portions are assembled.

Reference numeral 55B denotes a high-pressure-stage fixed scroll attached to the outer case 53B. As indicated in FIG. 10, substantially as in the low-pressure stage, the fixed scroll 55B comprises an end plate 56B, a wrap portion 57B, a tubular portion 58B, a flange portion 59B, suction ports (not shown), a discharge port 61B, fixed-side cooling fins 62B, etc.

Further, substantially as in the first embodiment, the rotary shaft 18 is provided between the fixed scrolls 55A and 55B. The rotary shaft 18 is rotatably supported by the bottom portions of the outer cases 53A and 53B through the rotation bearings 19A and 19B. Eccentric bushings 63A and 63B are fitted around opposite ends of the rotary shaft 18.

The eccentric bushings 63A and 63B respectively include rotary shaft fitting holes 64A and 64B, in which the rotary shaft 18 is fittingly disposed, and connecting shaft fitting holes 65A and 65B, into which the connecting shaft 23 is rotatably fitted through eccentric bearings 25A and 25B. As indicated in FIG. 8, the connecting shaft 23 is rotatably attached to the rotary shaft 18 through the eccentric bearings 25A and 25B and the eccentric bushings 63A and 63B, and has a center axis offset from the center axis of the rotary shaft 18 by a distance δ.

Reference numeral 66A denotes a low-pressure-stage orbiting scroll. Substantially as in the first embodiment, the orbiting scroll 66A comprises an end plate 67A, a wrap portion 68A, a boss portion 69A, orbiting-side cooling fins 70A, etc. Reference numeral 66B denotes a high-pressure-stage orbiting scroll. Substantially as in the low-pressure stage, the orbiting scroll 66B comprises an end plate 67B, a wrap portion 68B, a boss portion 69B, orbiting-side cooling fins 70B, etc. The orbiting-side cooling fins 70B vertically extend substantially in the direction of flow of cooling air described later (the direction indicated by the arrows b4 in FIG. 10).

Next, reference numeral 71A denotes a low-pressure-stage cooling fan as a first cooling fan connected to one axial end of the rotary shaft 18. As shown in FIG. 9, substantially as in the first embodiment, the first cooling fan 71A comprises a centrifugal fan, by way of example. It is accommodated in the outer case 53A and is attached to the axial end of the rotary shaft 18 using an eccentric bushing 63A.

In the outer case 53A, there is provided an annular partition plate 72A as a first partition plate for providing a partition between the cooling fan 71A and the orbiting scroll 66A. The partition plate 72A includes an opening 73A formed at a central portion thereof. First flow inlet openings 75A (see FIG. 7) and first flow outlet openings 76A are formed in the outer case 53A. The outer case 53A is further provided with a first scroll duct 77A, first fixed-scroll air passage openings 78A and a first cooling device duct 80A.

Thus, the cooling structure of the low-pressure-stage compression portion 54A is arranged substantially in the same manner as in the first embodiment. When the compressor is operated, the cooling fan 71A is rotated with the rotary shaft 18, to thereby create currents of cooling air flowing in the directions indicated by the arrows a1, a2, a3 and a4 in FIG. 9, thus supplying cooling air to a reverse side of the fixed scroll 55A, a reverse side of the orbiting scroll 66A and the cooling device 47.

Reference numeral 71B denotes a high-pressure-stage cooling fan as a second cooling fan connected to the other axial end of the rotary shaft 18. As shown in FIG. 10, substantially as in the first embodiment, the second cooling fan 71B comprises a centrifugal fan, by way of example. It is accommodated in the outer case 53B and is attached to the axial end of the rotary shaft 18 using an eccentric bushing 63B.

In the first embodiment, the cooling fan 38B sucks the cooling air from the flow inlet openings 42B along the reverse side of the orbiting scroll 26B, and this cooling air is supplied to the reverse side of the fixed scroll 7B.

In the second embodiment, the high-pressure-stage cooling fan 71B is reversed with respect to an axial direction, relative to the first embodiment. As will be described later, the cooling fan 71B sucks cooling air from the flow inlet openings 75B into the bottom portion of the outer case 53B, and this cooling air is supplied to a reverse side of the fixed scroll 55B and a reverse side of the orbiting scroll 66B simultaneously.

Reference numeral 72B denotes one partition plate provided in the outer case 53B. The partition plate 72B, together with another partition plate 74B described later, form a second partition plate. Each of the partition plates 72B and 74B comprises an annular plate made of a metal or a resin, by way of example. The partition plates 72B and 74B are provided on axially opposite sides of the cooling fan 71B.

The partition plate 72B, which is provided on one axial side of the cooling fan 71B, is disposed so as to provide a partition between the electric motor 15 and the cooling fan 71B. The partition plate 72B includes an opening 73B formed on a radially inner side thereof, which allows cooling air to flow from the flow inlet openings 75B towards the radially inner side (the suction side) of the cooling fan 71B.

Reference numeral 74B denotes another partition plate provided in the outer case 53B. The partition plate 74B is disposed on the other axial side of the cooling fan 71B so as to provide a partition between the cooling fan 71B and the orbiting scroll 66B in the outer case 53B.

Reference numeral 75B denotes second flow inlet openings formed at a plurality of positions in the outer case 53B. As indicated in FIGS. 7, 8, 10 and 11, the second flow inlet openings 75B are located diametrically opposite to each other in the outer case 53B. They are open on one axial side of the outer case 53B (at a position on a side of the electric motor 15 relative to the partition plate 72B).

The flow inlet openings 75B face the rotation bearings 19B and the like. Therefore, during operation of the cooling fan 71B, as indicated by the arrows b1 in FIG. 10, the rotation bearings 19B can be efficiently cooled by cooling air sucked into the outer case 53B through the flow inlet openings 75B.

Reference numeral 75C denotes third flow inlet openings which assist the second flow inlet openings 75B in obtaining more cooling air. The third flow inlet openings 75C are formed between a plurality of fins of the intermediate case 52 accommodating the electric motor.

Reference numeral 76B denotes second flow outlet openings formed at, for example, two positions in the outer case 53B. Substantially as in the first embodiment, the second flow outlet openings 76B are formed on vertically opposite sides (an upper side and a lower side) of the outer case 53B. The flow outlet openings 76B are located radially outwardly from the cooling fan 71B, and are open at an axially intermediate portion of the outer case 53B between the partition plates 72B and 74B.

When the cooling fan 71B is operated, as indicated by the arrow b2 in FIG. 10, the cooling air that flows through the outer case 53B is discharged from the lower-side flow outlet opening 76B into the scroll duct 77B. Part of the cooling air is discharged through the upper-side flow outlet opening 76B and flows into a cooling device duct 80B described later.

Reference numeral 77B denotes a second scroll duct disposed on a radially outer side of the outer case 53B. The second scroll duct 77B comprises, for example, a box-like member having a hollow structure. The duct 77B covers the lower-side flow outlet opening 76B and extends from this position to the position of fixed-scroll air passages 78B beyond lower-side orbiting-scroll air passage openings 79B, which are described later.

The scroll duct 77B connects the flow outlet opening 76B, and the lower-side fixed-scroll air passage openings 78B and the lower-side orbiting-scroll air passage openings 79B, and guides the cooling air that has been discharged through the flow outlet opening 76B towards the reverse side of the fixed scroll 55B and the reverse side of the orbiting scroll 66B.

Reference numeral 78B denotes second fixed-scroll air passage openings formed on vertically opposite sides of the high-pressure-stage fixed scroll 55B. The second fixed-scroll air passage openings 78B are formed at positions corresponding to opposite ends of the fixed-side cooling fins 62B and are open on an outer surface side of the fixed scroll 55B. As indicated by the arrows b3 in FIG. 10, the fixed-scroll air passage openings 78B allow the cooling air flowing through the scroll duct 77B to flow on a reverse side of the end plate 56B along the fixed-side cooling fins 62B.

Reference numeral 79B denotes orbiting-scroll air passage openings formed on an upper side and a lower side of the outer case 53B. In this embodiment, the orbiting-scroll air passage openings are formed at two positions, by way of example. These orbiting-scroll air passage openings 79B are disposed on a side of the orbiting scroll 66B relative to the partition plate 74B. They are located radially outwardly from the orbiting scroll 66B, and open into the scroll duct 77B.

The lower-side orbiting-scroll air passage openings 79B are located between the lower-side flow inlet opening 75B and the lower-side fixed-side air passage openings 78B. As indicated by the arrows b4 in FIG. 10, the orbiting-scroll air passage openings 79B allow part of cooling air flowing through the duct 77B to flow along the orbiting-side cooling fins 70B on a reverse side of the end plate 67B (in a scroll-partition plate interspace 85 described later). Reference numeral 80B denotes a second cooling device duct connected to the upper-side flow outlet opening 76B. The second cooling device duct 80B is adapted to guide the cooling air discharged from the upper-side flow outlet opening 76B into the cooling device 47.

Reference numeral 81 denotes a scroll/partition plate interspace formed between the scrolls 55A and 66A and the partition plate 72A in the low-pressure-stage outer case 53A. Substantially as in the first embodiment, the scroll/partition plate interspace 81 faces a reverse side of the end plate 67A of the orbiting-scroll 66A, and the flow inlet passage openings 75A open into the interspace 81. Reference numeral 82 denotes a motor/partition plate interspace formed between the motor 15 and the partition plate 72A in the outer case 53A. A cooling fan 71A is accommodated in the motor/partition plate interspace 82, and the flow outlet openings 76A open into the interspace 82.

Reference numeral 83 denotes a motor/partition plate interspace formed between the motor 15 and one partition plate 72B in the high-pressure-stage outer case 53B. The flow inlet openings 75B open into the motor/partition plate interspace 83. Reference numeral 84 denotes a partition plate/partition plate interspace formed between the partition plates 72B and 74B in the outer case 53B. A cooling fan 71B is accommodated in the partition plate/partition plate interspace 84, and the flow outlet openings 76B open into the interspace 84. Reference numeral 85 denotes a scroll/partition plate interspace formed between the scrolls 55B and 66B and the other partition plate 74B in the outer case 53B. The scroll/partition plate interspace 85 faces the reverse side of the end plate 67B of the orbiting scroll 66B, and the orbiting-scroll air passage openings 79B open into the interspace 85.

A twin type scroll air compressor in the second embodiment is arranged in the above-mentioned manner. Next, flow of cooling air is described.

In the low-pressure-stage compression portion 54A, as indicated by the arrows a1, a2, a3 and a4 in FIG. 9, cooling air flows along substantially the same passages as in the first embodiment. When the cooling fan 71A is operated, cooling air is sucked from the flow inlet openings 75A into the scroll/partition plate interspace 81 along the reverse side of the orbiting scroll 66A. Then, the cooling air flows from the motor/partition plate interspace 82 through the upper-side and lower-side flow outlet openings 76A into the ducts 77A and 80A, thus cooling the fixed scroll 55A and the cooling device 47.

On the other hand, in the high-pressure-stage compression portion 54B, as indicated by the arrows b1 in FIG. 10, cooling air is sucked from the flow inlet openings 75B into the motor/partition plate interspace 83 by operation of the cooling fan 71B. This cooling air flows through the opening 73B of the partition plate 72B into the partition plate/partition plate interspace 84. The cooling air that has flowed into the partition plate/partition plate interspace 84 flows through the lower-side flow outlet opening 76B, from a radially outer side of the cooling fan 71B into the scroll duct 77B, as indicated by the arrow b2, while flowing from the upper-side flow outlet opening 76B into the cooling device duct 80.

In this case, as indicated by the arrows b3, part of the cooling air that has flowed into the scroll duct 77B is flowed along the reverse side of the fixed scroll 55B due to the upper-side and lower-side fixed-scroll air passage openings 78B, thus cooling the fixed scroll 55B. As indicated by the arrows b4, the remaining part of the cooling air is passed through the scroll/partition plate interspace 85 due to the upper-side and lower-side orbiting-scroll air passage openings 79B, thus cooling the orbiting scroll 66B.

Further, as indicated by the arrows b5, the cooling air that has flowed out of the upper-side flow outlet opening 76B is guided through the cooling device duct 80B and flows into the cooling device 47, to thereby increase a cooling efficiency of the cooling device 47.

In the second embodiment arranged as mentioned above, substantially the same working effects can be obtained as in the first embodiment.

Especially in the second embodiment, the high-pressure-stage cooling fan 71B is reversed relative to the first embodiment, and the orbiting-scroll air passage openings 79B are formed in the outer case 53B. Therefore, in the high-pressure-stage compression portion 54B, the cooling air sucked from the flow inlet openings 75B is divided into two currents of cooling air to be individually supplied to the fixed scroll 55B and the orbiting scroll 66B, respectively. Thus, the scrolls 55B and 66B can be simultaneously cooled by means of different flows of cooling air.

Therefore, it is possible to avoid that the cooling air heated by cooling one scroll flows towards the other scroll. Therefore, each of the scrolls 55B and 66B can be efficiently cooled by cooling air having low temperature, to thereby achieve high cooling performance.

In the high-pressure-stage outer case 53B, two partition plates 72B and 74B are provided on opposite sides of the cooling fan 71B. Therefore, an inner space of the outer case 53B can be divided between the flow inlet openings 75B, the flow outlet openings 76B and the orbiting-scroll air passage openings 79B by these partition plates 72B and 74B. Thus, three spaces, namely, the motor/partition plate interspace 83, the partition plate/partition plate interspace 84 and the scroll/partition plate interspace 85, can be defined in the outer case 53B.

With these arrangements, when the cooling fan 71B is operated, as indicated in FIG. 10, the cooling air flowing in the direction indicated by the arrows b1, which is sucked through the flow inlet openings 75B into the motor/partition plate interspace 83, the cooling air flowing in the direction indicated by the arrow b2, which flows from the partition plate/partition plate interspace 84 through the flow outlet openings 76B into the scroll duct 77B, and the cooling air flowing in the direction indicated by the arrows b4, which flows through the orbiting-scroll air passage openings 79B into the scroll/partition plate interspace 85, are not mixed with each other, thus reliably separating the three currents of cooling air by means of the partition plates 72B and 74B. Therefore, currents of cooling air can be stably formed by a simple structure using the partition plates 72B and 74B.

In the low-pressure-stage compression portion 54A, substantially as in the first embodiment, both the fixed scroll 55A and the orbiting scroll 66A can be cooled in series by using a single current of cooling air. Therefore, a cooling structure for cooling the two scrolls can be simplified.

Thus, in a twin wrap type scroll air compressor, simplification of a cooling structure is preferentially achieved in the low-pressure-stage compression portion 54A, which is maintained at a relatively low temperature during compressor operation, while an increase in cooling efficiency is preferentially attained in the high-pressure-stage compression portion 54B, which is rapidly heated. Therefore, a compressor that is compact and has high performance can be easily obtained.

In the above embodiments, the flow inlet openings 42A, 42B, 75A and 75B are formed in surfaces on horizontally opposite sides of the outer case, and the flow outlet openings 43A, 43B, 76A and 76B are formed in surfaces on vertically opposite sides (an upper side and a lower side) of the outer case. However, this does not limit the present invention. The flow inlet openings and the flow outlet openings may be formed in any positions as long as they do not interfere with each other. For example, the flow inlet openings may be formed in surfaces on vertically opposite sides (an upper side and a lower side) of the outer case, with the flow outlet openings being formed in surfaces on horizontally opposite sides of the outer case.

In the above embodiments, the connecting shaft 23 extends through the rotary shaft 18, and thus the rotary shaft 18 and the crank portions 24A and 24B at opposite ends of the connecting shaft 23 are formed by different members. However, this does not limit the present invention. Crank portions may be formed integrally with opposite ends of the rotary shaft, with the boss portions 29A and 29B of the orbiting scrolls 26A and 26B being orbitably connected to these crank portions through bearings.

In the above embodiments, the cooling device 47 comprising a twin cooler is provided on an upper side of the casing 1. However, this does not limit the present invention. The present invention may be applied to a scroll type fluid machine having no cooling device 47, or a scroll type fluid machine having either one of an intercooler and an aftercooler as a cooling device.

In the above embodiments, a scroll type air compressor is taken as an example of a scroll type fluid machine. This does not limit the present invention. The present invention may be applied to other scroll type fluid machines, including a refrigerant compressor and a vacuum pump.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The entire disclosure of Japanese Patent Application No. 2003-434485 filed on Dec. 26, 2003 including specification, claims, drawings and summary is incorporated herein by reference in its entirety.

The invention claimed is:

1. A scroll type fluid machine comprising:

a fixed-side member including a casing and a fixed scroll provided in the casing, the fixed scroll being formed by an end plate and a spiral wrap portion extending from a front surface of the end plate;

a rotary shaft supported by the casing; and an orbiting scroll connected to the rotary shaft at a position where the orbiting scroll faces the fixed scroll, the orbiting scroll being formed by an end plate and a wrap portion extending from a front surface of the end plate, the wrap portion of the orbiting scroll overlapping the wrap portion of the fixed scroll, to thereby form a plurality of compression chambers, the rotary shaft being provided with a cooling fan accommodated in the fixed-side member, the cooling fan being adapted to rotate with the rotary shaft at a position where the cooling fan faces the orbiting scroll, the fixed-side member being provided with a flow inlet opening disposed to cause cooling air to be sucked along a reverse side of the orbiting scroll end plate during rotation of the cooling fan, a flow outlet opening for allowing the cooling air sucked from the flow inlet opening to be discharged from the fixed-side member by operation of the cooling fan, and a scroll duct for guiding the cooling air discharged from the flow outlet opening towards a reverse side of the fixed scroll end plate.

2. A scroll type fluid machine comprising:

a fixed-side member including a casing and first and second fixed scrolls provided on opposite sides of the casing, each of the first and second fixed scrolls being formed by an end plate and a spiral wrap portion extending from a front surface of the end plate;

a rotary shaft supported by the casing and adapted to be rotatably driven; and first and second orbiting scrolls connected to the rotary shaft at a position where the first and second orbiting scrolls face the first and second fixed scrolls, respectively, each of the first and second orbiting scrolls being formed by an end plate and a wrap portion extending from a front surface of the end plate, the wrap portion of the first orbiting scroll overlapping the wrap portion of the first fixed scroll, thereby forming a plurality of compression chambers, the wrap portion of the second orbiting scroll overlapping the wrap portion of the second fixed scroll, thereby forming a plurality of compression chambers, the rotary shaft being provided with first and second cooling fans accommodated in the fixed-side member on axially opposite sides of the rotary shaft, the first and second cooling fans being adapted to rotate with the rotary shaft, at a position where the first and second cooling fins face the first and second orbiting scrolls, respectively, the first and the second cooling fans being disposed so as to face in the same direction, the first fixed scroll and the first orbiting scroll forming a low-pressure stage compression chamber, the second fixed scroll and the second orbiting scroll forming a high-pressure stage compression chamber, the fixed-side member being provided with a first flow inlet opening for sucking cooling air along a reverse side of the end plate of the first orbiting scroll during rotation of the first cooling fan, a first flow outlet opening for allowing the cooling air sucked from the first flow inlet opening to be discharged from the fixed-side member by operation of the first cooling fan, and a first scroll duct for guiding the cooling air discharged from the first flow outlet opening towards a reverse side of the end plate of the first fixed scroll, the fixed-side member being further provided with a second flow inlet opening for sucking cooling air into the casing during rotation of the second cooling fan, a second flow outlet opening for allowing the cooling air sucked from the second flow inlet opening to be discharged from the fixed-side member by operation of the second cooling fan, a second scroll duct for guiding the cooling air discharged from the second flow outlet opening towards a reverse side of the end plate of the second fixed scroll, and an air passage opening for allowing part of the cooling air flowing through the second scroll duct to flow into a space formed on a reverse side of the end plate of the second orbiting scroll.

3. A scroll type fluid machine according to claim 1, wherein:

a partition plate is provided in the fixed-side member so as to provide a partition between the orbiting scroll and the cooling fan;

the flow inlet opening is disposed on a side of the orbiting scroll relative to the partition plate; and the flow outlet opening is disposed on a side opposite to the flow inlet opening relative to the partition plate.

4. A scroll type fluid machine according to claim 2, wherein:

two partition plates, one of which provides a partition between the electric motor and the cooling fan and the other of which provides a partition between the cooling fan and the orbiting scroll, are provided in the fixed-side member;

the flow inlet opening is disposed on a side of the electric motor relative to said one partition plate;

the flow outlet opening is disposed between said one partition plate and said other partition plate; and the air passage opening is disposed on a side of the orbiting scroll relative to said other partition plate.

5. A scroll type fluid machine according to claim 2, wherein:

a cooling device is provided outside the fixed-side member, the cooling device being adapted to cool a gas sucked into the compression chambers or a gas discharged from the compression chambers;

the flow outlet opening is formed at each of two positions in the fixed-side member which are different from a position of the flow inlet opening; and the flow outlet opening formed at one of the two positions is connected to the scroll duct, and the flow outlet opening formed at the other position is connected to a cooling device duct for guiding cooling air into the cooling device.

6. A scroll type fluid machine according to claim 2, wherein:

two partition plates, one of which provides a partition between the electric motor and the cooling fan and the other of which provides a partition between the cooling fan and the orbiting scroll, are provided in the fixed-side member;

the flow inlet opening is disposed on a side of the electric motor relative to said one partition plate;

the flow outlet opening is disposed between said one partition plate and said other partition plate; and the air passage opening is disposed on a side of the orbiting scroll relative to said other partition plate.

7. A scroll type fluid machine according to claim 2, wherein:

a cooling device is provided outside the fixed-side member, the cooling device being adapted to cool a gas sucked into the compression chambers or a gas discharged from the compression chambers;

the flow outlet opening is formed at each of two positions in the fixed-side member which are different from a position of the flow inlet opening; and the flow outlet opening formed at one of the two positions is connected to the scroll duct, and the flow outlet opening formed at the other position is connected to a cooling device duct for guiding cooling air into the cooling device.

8. A scroll type fluid machine according to claim 2, wherein:

the flow inlet opening and the flow outlet opening are formed at different positions;

a plurality of orbiting-side cooling fins are formed on the reverse side of the orbiting scroll end plate so as to extend in a direction of flow of cooling air flowing from the flow inlet opening; and a plurality of fixed-side cooling fins are formed on the reverse side of the fixed scroll end plate so as to extend in a direction of flow of cooling air guided from the flow outlet opening through the scroll duct.

* * * * *